US009516910B2

(12) United States Patent
Szalkowski et al.

(10) Patent No.: US 9,516,910 B2
(45) Date of Patent: Dec. 13, 2016

(54) HELMET IMPACT LINER SYSTEM

(75) Inventors: Ron Szalkowski, Lakewood, OH (US); Shawn Thomas, Lexington, KY (US)

(73) Assignee: Intellectual Property Holdings, LLC, Cleveland, OH (US)

( * ) Notice: Subject to any disclaimer, the term of this patent is extended or adjusted under 35 U.S.C. 154(b) by 915 days.

(21) Appl. No.: 13/535,767

(22) Filed: Jun. 28, 2012

(65) Prior Publication Data

US 2013/0000017 A1 Jan. 3, 2013

Related U.S. Application Data

(60) Provisional application No. 61/503,822, filed on Jul. 1, 2011.

(51) Int. Cl.
*A42B 3/12* (2006.01)
*F41H 1/08* (2006.01)

(52) U.S. Cl.
CPC ..... *A42B 3/127* (2013.01); *F41H 1/08* (2013.01)

(58) Field of Classification Search
CPC ..... A42B 3/28; A42B 3/285; A42B 3/286; F41H 1/08
See application file for complete search history.

(56) References Cited

U.S. PATENT DOCUMENTS

| | | | | |
|---|---|---|---|---|
| 666,130 | A | 1/1901 | Cole | |
| 957,394 | A | 5/1910 | Thoma | |
| 1,012,597 | A | 12/1911 | Church | |
| 1,539,283 | A | 5/1925 | Staats-Oels | |
| 1,552,965 | A | 9/1925 | Smith | |
| 1,560,825 | A | 11/1925 | Kelticka | |
| 1,958,050 | A * | 5/1934 | Koppelman | B65D 65/44 162/116 |
| 2,074,331 | A | 3/1937 | Haider | |

(Continued)

FOREIGN PATENT DOCUMENTS

| | | |
|---|---|---|
| CA | 2598015 | 8/2006 |
| CA | 2663728 | 9/2008 |

(Continued)

OTHER PUBLICATIONS

International Search Report and Written Opinion for International Patent Application No. PCT/US1 2/59474 dated Jan. 7, 2013.

(Continued)

*Primary Examiner* — Richale Quinn
(74) *Attorney, Agent, or Firm* — Calfee, Halter & Griswold LLP

(57) ABSTRACT

The present application discloses an impact liner system for a helmet. In one embodiment, the impact liner system comprises an impact liner configured to be installed in the interior of a helmet shell to at least partially line the front, rear, and middle portions of the helmet shell. The impact liner comprises a plurality of impact pads and forms a plurality of air channels between the impact pads when the impact liner is installed in the helmet shell. In certain embodiments, at least one insert is disposed within one or more of the plurality of air channels. The insert generally comprises a body portion having a top and vertical side walls configured to prohibit at least a portion of the air channel from collapsing when the helmet shell is installed on a user's head.

27 Claims, 11 Drawing Sheets

(56) References Cited

U.S. PATENT DOCUMENTS 2,090,881 A 8/1937 Wilson
2,221,310 A 11/1940 Gazelle
2,275,575 A 3/1942 Vrooman
2,285,335 A 6/1942 Hurt
2,303,744 A 12/1942 Jacobs
2,311,373 A 2/1943 Duming
2,318,077 A 5/1943 Jonas
2,346,161 A 4/1944 Grant
2,349,907 A 5/1944 Kos
2,433,012 A 12/1947 Zalicovitz
2,434,641 A 1/1948 Burns
2,649,019 A 8/1953 Hartline
2,711,033 A 6/1955 Dick
2,739,093 A 3/1956 Bull
2,759,186 A 8/1956 Dye
2,772,196 A 11/1956 Pooley
2,776,452 A 1/1957 Chavannes
2,983,056 A 5/1961 Murawski
3,018,015 A 1/1962 Agriss et al.
3,026,231 A 3/1962 Chavannes
3,039,109 A * 6/1962 Simpson ..... A42B 3/121 2/413
3,086,899 A * 4/1963 Ingraham ..... B32B 27/00 105/422
3,088,539 A 5/1963 Mathues et al.
3,099,043 A 7/1963 Held
3,124,807 A 3/1964 Frenkel et al.
3,142,599 A 7/1964 Chavannes
3,144,247 A 8/1964 Szonn et al.
3,153,792 A * 10/1964 Marietta ..... A42B 3/127 2/414
3,160,963 A 12/1964 Aaskov
3,186,013 A 6/1965 Glassman et al.
3,195,686 A 7/1965 Johnson
3,231,454 A 1/1966 Williams
3,242,500 A 3/1966 Derr
3,251,076 A 5/1966 Burke
3,280,410 A 10/1966 Propst et al.
3,327,334 A 6/1967 Wilmanns et al.
3,342,666 A 9/1967 Hull
3,366,971 A * 2/1968 Scherz ..... A42B 3/10 112/420
3,378,888 A 4/1968 Robertson
3,425,061 A 2/1969 Webb
3,447,163 A 6/1969 Bothwell et al.
3,484,835 A 12/1969 Trountine et al.
3,500,472 A * 3/1970 Castellani ..... A42B 3/12 2/22
3,500,475 A 3/1970 Otsuka
3,507,727 A 4/1970 Marshack
3,508,992 A 4/1970 Chavannes et al.
3,514,156 A 5/1970 Fields
3,525,663 A 8/1970 Hale
3,538,628 A 11/1970 Einstein, Jr.
3,575,781 A 4/1971 Pezely
3,600,714 A * 8/1971 Cade ..... A42B 3/121 2/413
3,608,215 A 9/1971 Fukuoka
3,609,764 A * 10/1971 Morgan ..... A42B 3/122 2/414
3,618,144 A 11/1971 Frey et al.
3,633,228 A 1/1972 Zysman
3,668,056 A 6/1972 Hayes, Jr.
3,668,704 A 6/1972 Conroy
3,673,609 A 7/1972 De Simone
3,679,166 A 7/1972 Sturhan
3,684,235 A 8/1972 Schupbach
3,709,967 A 1/1973 Held, Jr.
3,713,640 A * 1/1973 Margan ..... F16F 13/06 2/413
3,716,614 A 2/1973 Okamoto et al.
3,729,744 A * 5/1973 Rappleyea ..... A42B 3/127 2/420
3,747,968 A 7/1973 Hornsby
3,761,959 A * 10/1973 Dunning ..... A42B 3/122 137/223
3,766,669 A 10/1973 Pearsall
3,782,767 A 1/1974 Moore
3,783,450 A * 1/1974 O'Connor ..... A42B 3/28 2/421
3,784,985 A 1/1974 Conroy
3,806,950 A 4/1974 Spencer-Foote
3,837,991 A 9/1974 Evans
3,849,801 A * 11/1974 Holt ..... A42B 3/121 2/413
3,853,221 A 12/1974 Boyd
3,857,144 A 12/1974 Bustin
3,863,909 A 2/1975 Weber
3,871,636 A 3/1975 Boyle
3,872,511 A * 3/1975 Nichols ..... A42B 3/121 2/413
3,877,076 A 4/1975 Summers
3,882,547 A * 5/1975 Morgan ..... A42B 3/121 2/414
3,884,862 A 5/1975 King
3,895,456 A 7/1975 Fabre
3,900,222 A 8/1975 Muller
3,911,187 A 10/1975 Raley
3,926,463 A 12/1975 Landwehr
3,928,881 A 12/1975 Bente
3,933,387 A 1/1976 Salloum et al.
3,940,529 A 2/1976 Hepford et al.
3,940,811 A 3/1976 Tomikawa et al.
3,952,358 A 4/1976 Fukuoka
3,971,583 A 7/1976 Kornhuser
D241,228 S 8/1976 Boduch
3,994,020 A 11/1976 Villari
3,995,901 A 12/1976 Filbert, Jr. et al.
3,997,207 A 12/1976 Norlin
3,999,220 A 12/1976 Keltner
4,022,505 A 5/1977 Saczawa, Jr.
4,023,213 A * 5/1977 Rovani ..... A42B 3/121 2/413
4,029,350 A 6/1977 Goupy et al.
4,029,534 A 6/1977 Bocks et al.
4,038,700 A 8/1977 Gyory
4,044,399 A 8/1977 Morton
4,044,479 A 8/1977 Brutting
4,064,565 A 12/1977 Griffiths
4,067,063 A 1/1978 Ettinger
4,075,717 A 2/1978 Lemelson
4,077,393 A * 3/1978 Mattson ..... F24J 2/1047 126/652
4,099,759 A 7/1978 Kornhauser
4,101,983 A 7/1978 Dera et al.
4,106,745 A 8/1978 Carrow
4,110,857 A 9/1978 Banister
4,114,197 A 9/1978 Morton
4,134,156 A 1/1979 Gyory
4,151,661 A 5/1979 Namba
4,154,469 A 5/1979 Goupy et al.
4,154,489 A 5/1979 Lyman
4,170,078 A 10/1979 Moss
4,187,620 A 2/1980 Selner
4,190,276 A 2/1980 Hirano
4,192,699 A 3/1980 Lewicki et al.
4,213,202 A 7/1980 Larry
4,223,455 A 9/1980 Vermeulen
4,223,456 A 9/1980 Cohen
4,236,326 A 12/1980 Inohara
4,239,106 A 12/1980 Aileo
4,239,476 A 12/1980 Somberg
4,251,932 A 2/1981 Love
4,262,433 A 4/1981 Hagg
4,267,648 A 5/1981 Weisz
4,279,038 A 7/1981 Bruckner et al.
4,287,613 A * 9/1981 Schulz ..... A42B 3/145 2/413
4,288,399 A 9/1981 Siedenstrang et al.
4,290,149 A 9/1981 Aileo
4,297,797 A 11/1981 Meyers
4,299,038 A 11/1981 Epple

(56) References Cited

U.S. PATENT DOCUMENTS 4,302,892 A 12/1981 Adamik
4,305,212 A 12/1981 Coomer
4,307,471 A 12/1981 Lovell
4,321,989 A 3/1982 Meinzer
4,338,371 A 7/1982 Dawn et al.
4,342,157 A 8/1982 Gilbert
4,342,158 A 8/1982 McMahon
4,345,338 A * 8/1982 Frieder, Jr. ..... A42C 2/007 2/414
4,347,637 A 9/1982 Ardito
4,352,484 A 10/1982 Gertz
4,355,792 A 10/1982 Fukuda
4,356,642 A 11/1982 Herman
D267,287 S * 12/1982 Gooding ..... A42B 3/28 D29/122
D267,831 S 2/1983 Sucato
4,370,754 A 2/1983 Donzis
4,372,058 A 2/1983 Stubblefield
4,377,042 A 3/1983 Bauer
4,391,048 A 7/1983 Lutz
4,398,357 A 8/1983 Batra
4,400,483 A 8/1983 Siedenstrang et al.
4,400,894 A 8/1983 Ehrlich
4,413,856 A 11/1983 McMahan et al.
4,418,483 A 12/1983 Fujita
4,423,000 A 12/1983 Teraoka
4,428,306 A 1/1984 Dresen et al.
4,432,099 A 2/1984 Grick et al.
4,439,936 A 4/1984 Clarke et al.
4,445,283 A 5/1984 Meyers
4,449,307 A 5/1984 Stubblefield
4,453,271 A 6/1984 Donzis
4,455,765 A 6/1984 Sjosward
4,458,430 A 7/1984 Peterson
4,460,205 A 7/1984 Glance
4,472,472 A 9/1984 Schultz
4,494,320 A 1/1985 Davis
4,497,123 A 2/1985 Ehrlich
4,510,702 A 4/1985 Ehrlich, Jr.
4,513,449 A 4/1985 Donzis
4,518,643 A 5/1985 Francis
4,523,393 A 6/1985 Inohara
4,534,068 A 8/1985 Mitchell et al.
4,535,553 A 8/1985 Derderian et al.
4,538,301 A 9/1985 Sawatzki et al.
4,538,366 A 9/1985 Norton
4,546,555 A 10/1985 Spademan
4,553,342 A 11/1985 Derderian et al.
4,558,470 A 12/1985 Mitchell et al.
4,562,651 A 1/1986 Frederick et al.
4,566,137 A 1/1986 Gooding
4,566,678 A 1/1986 Anderson
4,578,296 A 3/1986 Miyazaki
4,586,200 A 5/1986 Poon
4,601,367 A 7/1986 Bongers
4,614,000 A 9/1986 Mayer
4,616,431 A 10/1986 Dassler
4,619,055 A 10/1986 Davidson
4,624,061 A 11/1986 Wezel et al.
4,627,114 A 12/1986 Mitchell
4,631,221 A 12/1986 Disselbeck et al.
4,635,384 A 1/1987 Huh et al.
4,635,981 A 1/1987 Friton
4,642,814 A 2/1987 Godfrey
4,657,716 A 4/1987 Schmidt
4,666,130 A 5/1987 Denman
4,667,423 A 5/1987 Autry et al.
4,670,995 A 6/1987 Huang
4,672,754 A 6/1987 Ehrlich
4,676,010 A 6/1987 Cheskin
4,680,875 A 7/1987 DAnieli
4,695,496 A 9/1987 Lee
4,700,403 A 10/1987 Vacanti
4,703,879 A 11/1987 Kastendieck
4,704,746 A 11/1987 Nava
4,710,984 A 12/1987 Asper
4,720,261 A 1/1988 Fishwick et al.
4,722,131 A 2/1988 Huang
4,724,549 A 2/1988 Herder et al.
4,730,402 A 3/1988 Norton et al.
4,739,762 A 4/1988 Palmaz
4,741,114 A 5/1988 Stubblefield
4,753,021 A 6/1988 Cohen
4,759,136 A 7/1988 Stewart et al.
4,763,426 A 8/1988 Polus et al.
4,766,614 A 8/1988 Cantwell et al.
4,768,295 A 9/1988 Ito
4,798,009 A 1/1989 Colonel et al.
4,808,469 A 2/1989 Hiles
4,815,221 A 3/1989 Diaz
4,817,304 A 4/1989 Parker et al.
4,823,483 A 4/1989 Chapncik
4,831,750 A 5/1989 Muller
4,838,606 A 6/1989 Furubayashi et al.
4,842,931 A 6/1989 Zook
4,843,741 A 7/1989 Yung-Mao
4,844,213 A 7/1989 Travis
4,845,786 A 7/1989 Chiarella
4,845,861 A 7/1989 Moundjian
4,845,863 A 7/1989 Yung-Mao
4,852,704 A 8/1989 Brockenbrough
4,853,980 A * 8/1989 Zarotti ..... A42B 3/285 2/413
4,856,208 A 8/1989 Zaccaro
4,856,833 A 8/1989 Beekman
4,858,343 A 8/1989 Flemming
4,858,606 A 8/1989 Hamlin
4,872,220 A 10/1989 Haruvy et al.
4,876,053 A 10/1989 Norton
4,883,299 A 11/1989 Bonar
4,887,369 A 12/1989 Bailey
4,890,877 A 1/1990 Ashtiani-Zarandi et al.
4,899,467 A 2/1990 Mackey
4,901,987 A 2/1990 Greenhill et al.
4,904,008 A 2/1990 Glance
4,905,382 A 3/1990 Yung-Mao
4,909,661 A 3/1990 Ivey
4,912,861 A 4/1990 Huang
4,916,759 A 4/1990 Arai
4,918,841 A 4/1990 Turner
4,920,663 A 5/1990 Flemming
4,922,630 A 5/1990 Robinson
4,922,631 A 5/1990 Anderie
4,923,650 A 5/1990 Antoon, Jr. et al.
4,925,224 A 5/1990 Smiszek
4,930,231 A 6/1990 Liu
4,931,115 A 6/1990 Pajunen
4,934,071 A 6/1990 Virgini
4,941,701 A 7/1990 Loren
4,951,986 A 8/1990 Hanfusa et al.
D310,893 S 9/1990 Broersma
4,969,680 A 11/1990 Shimoda
4,970,729 A 11/1990 Shimazaki
4,972,611 A 11/1990 Swartz
4,984,320 A 1/1991 Curley, Jr. et al.
4,987,609 A 1/1991 Zahn
4,993,173 A 2/1991 Gardener
4,999,931 A 3/1991 Vermeulen
5,011,642 A 4/1991 Welygan et al.
5,014,449 A 5/1991 Richard et al.
5,014,691 A 5/1991 Cueman et al.
5,016,417 A 5/1991 Mentken
5,025,504 A 6/1991 Benston et al.
5,027,803 A 7/1991 Scholtz et al.
5,030,501 A 7/1991 Colvin et al.
5,033,593 A 7/1991 Kazuhito
5,035,009 A * 7/1991 Wingo, Jr. ..... A42B 3/121 2/414
5,035,758 A 7/1991 Degler et al.
5,042,174 A 8/1991 Nichols
5,042,175 A 8/1991 Romen et al.
5,042,176 A 8/1991 Rudy
5,042,859 A 8/1991 Zhang et al.
5,044,096 A 9/1991 Polegato

(56) References Cited

U.S. PATENT DOCUMENTS 5,046,267 A 9/1991 Kilgore et al.
5,048,203 A 9/1991 Kling
5,056,162 A 10/1991 Tirums
5,058,212 A 10/1991 Kamata
5,066,400 A 11/1991 Rocklitz et al.
5,068,922 A 12/1991 Zahn
5,083,320 A 1/1992 Halstead
5,083,361 A 1/1992 Rudy
5,086,033 A 2/1992 Armor et al.
5,092,060 A 3/1992 Frachey et al.
5,093,938 A 3/1992 Kamata
5,097,607 A 3/1992 Fredericksen
5,098,124 A 3/1992 Breed et al.
5,124,191 A 6/1992 Seksaria
5,131,174 A 7/1992 Drew et al.
5,150,935 A 9/1992 Glance et al.
5,165,990 A 11/1992 Nakano
5,168,576 A 12/1992 Krent et al.
5,175,889 A * 1/1993 Infusino ..... A42B 3/122 2/413
5,204,998 A 4/1993 Liu
5,224,277 A 7/1993 Sang Do
5,235,715 A 8/1993 Donzis
5,244,745 A 9/1993 Seksaria
5,263,203 A * 11/1993 Kraemer ..... A42B 3/122 2/413
5,271,103 A 12/1993 Darnell
5,274,846 A 1/1994 Kolsky
5,280,890 A 1/1994 Wydra
5,282,288 A 2/1994 Henson
5,324,460 A 6/1994 Briggs
5,330,249 A 7/1994 Weber et al.
5,376,318 A 12/1994 Ho
5,409,200 A 4/1995 Zingher et al.
5,421,035 A 6/1995 Klose et al.
5,423,087 A 6/1995 Krent et al.
5,439,733 A 8/1995 Paire
D364,487 S 11/1995 Tutton et al.
5,477,558 A * 12/1995 Volker ..... A41D 13/0153 2/16
5,493,791 A 2/1996 Kramar
5,543,194 A 8/1996 Rudy
5,545,128 A * 8/1996 Hayes ..... A41D 13/0156 2/465
5,551,094 A 9/1996 Navone
5,555,584 A 9/1996 Moore et al.
5,572,804 A 11/1996 Skaja et al.
5,581,818 A 12/1996 Lorenzi et al.
5,581,819 A 12/1996 Larneau
5,588,165 A 12/1996 Fromme
5,591,379 A 1/1997 Shores
5,595,003 A 1/1997 Snow
5,598,588 A 2/1997 Lee
5,611,153 A 3/1997 Fisher et al.
5,655,226 A 8/1997 Williams
5,669,079 A 9/1997 Morgan
5,734,994 A 4/1998 Rogers
5,741,568 A 4/1998 Rudy
5,766,704 A 6/1998 Allen et al.
5,891,372 A 4/1999 Besset et al.
5,913,412 A 6/1999 Huber et al.
5,915,537 A 6/1999 Dallas et al.
5,946,734 A 9/1999 Vogan
5,950,244 A * 9/1999 Fournier ..... A42B 3/128 2/411
D415,420 S 10/1999 Chen
5,976,451 A 11/1999 Skaja et al.
5,983,405 A 11/1999 Casale
5,992,054 A 11/1999 Rauch
5,996,126 A 12/1999 Barthold et al.
6,029,962 A 2/2000 Shorten et al.
6,051,624 A 4/2000 Bastin et al.
D424,246 S 5/2000 Ho
D426,032 S 5/2000 Ho
6,070,271 A 6/2000 Williams
6,085,878 A 7/2000 Araki et al.
6,093,468 A * 7/2000 Toms ..... A41D 13/0158 2/22
6,098,313 A 8/2000 Skaja
6,105,162 A 8/2000 Douglas et al.
6,105,176 A 8/2000 Egger
6,108,825 A 8/2000 Bell et al.
6,154,889 A 12/2000 Moore, III et al.
6,199,942 B1 3/2001 Carroll et al.
6,219,850 B1 4/2001 Halstead et al.
6,226,801 B1 * 5/2001 Alexander ..... A42B 3/122 2/413
6,247,745 B1 6/2001 Carroll et al.
D447,604 S 9/2001 Walters et al.
6,298,497 B1 10/2001 Chartrand
6,326,077 B1 12/2001 Monaci
6,351,854 B1 3/2002 Whalen et al.
6,353,953 B1 3/2002 Tanaka et al.
D455,522 S 4/2002 Royes et al.
6,378,140 B1 4/2002 Abraham
6,381,759 B1 5/2002 Katz
6,383,431 B1 5/2002 Dobrin et al.
6,391,935 B1 5/2002 Hager et al.
6,425,141 B1 7/2002 Ewing et al.
6,434,755 B1 8/2002 Halstead et al.
6,443,513 B1 9/2002 Glance
6,446,270 B1 9/2002 Durr
6,453,476 B1 9/2002 Moore, III
D464,174 S 10/2002 Lu
6,457,261 B1 10/2002 Crary
6,460,207 B1 10/2002 Papay et al.
6,467,099 B2 10/2002 Dennis et al.
6,485,446 B1 11/2002 Brother et al.
6,499,147 B2 12/2002 Schiebl et al.
6,532,602 B2 3/2003 Watters et al.
6,533,258 B2 3/2003 Monson et al.
6,536,052 B2 3/2003 Tao et al.
6,550,850 B2 4/2003 Laborie et al.
D475,486 S 6/2003 Ide et al.
6,604,246 B1 8/2003 Obreja
D481,171 S 10/2003 Ho
6,634,045 B1 10/2003 DuDonis et al.
6,658,671 B1 12/2003 Von Holst et al.
6,671,889 B2 1/2004 Dennis et al.
6,679,544 B1 1/2004 Hubbert et al.
6,679,967 B1 1/2004 Carroll, III et al.
6,681,409 B2 1/2004 Dennis et al.
6,682,128 B2 1/2004 Carroll, III et al.
D491,695 S 6/2004 Long
6,752,450 B2 6/2004 Carroll, III et al.
D492,818 S 7/2004 Ide et al.
D495,096 S 8/2004 Long
6,803,005 B2 10/2004 Dennis et al.
6,926,947 B1 8/2005 Seckel
6,994,333 B2 2/2006 Lobry et al.
D521,191 S 5/2006 Berger
D523,180 S 6/2006 Frye
7,078,443 B2 7/2006 Milliren
D535,059 S 1/2007 Lam
7,178,175 B2 2/2007 Rogers et al.
D541,480 S 4/2007 Turner
7,228,648 B2 6/2007 Yang
7,240,376 B2 7/2007 Ide et al.
7,255,910 B1 8/2007 Seckel
7,299,505 B2 11/2007 Dennis et al.
7,316,036 B2 1/2008 Rudolf et al.
7,338,038 B2 3/2008 Maurer et al.
7,341,776 B1 3/2008 Milliren et al.
7,360,822 B2 4/2008 Carroll, III et al.
D570,055 S 5/2008 Ferrara et al.
7,377,577 B2 5/2008 Carroll, III et al.
7,384,095 B2 6/2008 Cormier
7,404,593 B2 7/2008 Cormier
D577,866 S 9/2008 Frye et al.
D581,599 S 11/2008 Ferrara et al.
D582,607 S 12/2008 Ferrara et al.
7,458,172 B2 12/2008 Aveni

(56) References Cited

U.S. PATENT DOCUMENTS 7,464,414 B2 * 12/2008 McDuff ..... A42B 3/127 2/455
D584,456 S 1/2009 Ferrara
7,513,344 B2 4/2009 Toccalino
7,574,760 B2 8/2009 Foley et al.
D603,103 S 10/2009 Ferrara et al.
7,600,268 B2 10/2009 Rogers et al.
7,603,725 B2 10/2009 Harris
7,625,023 B2 12/2009 Audi et al.
D608,688 S 1/2010 Dalzell et al.
7,673,351 B2 3/2010 Copeland et al.
7,676,854 B2 3/2010 Berger et al.
7,677,538 B2 3/2010 Darnell et al.
D617,503 S * 6/2010 Szalkowski ..... A43B 3/122 D29/122
7,730,635 B2 6/2010 Aveni et al.
D621,099 S 8/2010 Johnson et al.
D622,449 S 8/2010 Culley et al.
7,770,239 B1 8/2010 Goldman
7,774,866 B2 * 8/2010 Ferrara ..... A42B 3/121 2/455
7,802,320 B2 9/2010 Morgan
7,827,617 B2 11/2010 Trainor et al.
7,857,610 B2 12/2010 Rossi et al.
7,866,248 B2 1/2011 Moore et al.
7,895,681 B2 3/2011 Ferrara
D637,356 S 5/2011 Green et al.
7,950,073 B2 5/2011 Ferrara
D640,422 S 6/2011 Green et al.
7,959,023 B2 6/2011 Ferrara
7,960,473 B2 6/2011 Kobayashi et al.
D645,210 S 9/2011 Chilson et al.
8,039,078 B2 10/2011 Moore et al.
8,047,602 B2 11/2011 Sielhorst et al.
8,056,972 B2 11/2011 Marsden
D650,132 S 12/2011 Chilson et al.
8,069,498 B2 12/2011 Maddux et al.
8,087,187 B2 1/2012 Aveni et al.
8,104,593 B2 1/2012 Lin
D654,628 S 2/2012 Aris et al.
D655,048 S 2/2012 Moeller et al.
D655,051 S 2/2012 O'Keefe et al.
8,201,269 B2 6/2012 Maddux
8,205,272 B2 * 6/2012 Green ..... A42B 1/08 2/209.13
D663,076 S 7/2012 Parsons et al.
8,220,072 B2 * 7/2012 Dodd ..... A41D 13/0153 2/22
D665,663 S 8/2012 Krupa
D666,779 S 9/2012 Harris
8,298,648 B2 10/2012 Turner
8,348,031 B2 1/2013 Smaldone et al.
D677,006 S 2/2013 Pfanner et al.
D679,058 S * 3/2013 Szalkowski ..... A42B 3/122 D29/122
8,387,164 B2 3/2013 Maddux et al.
8,399,085 B2 3/2013 Moore et al.
D683,905 S 6/2013 Wills
D691,329 S 10/2013 Anderson
8,544,117 B2 * 10/2013 Erb ..... A42B 3/122 2/410
8,561,214 B2 10/2013 Turner
8,590,869 B2 11/2013 Tavares et al.
8,702,895 B2 4/2014 Turner
8,713,719 B2 * 5/2014 Turner ..... A41D 13/05 2/22
8,726,424 B2 * 5/2014 Thomas ..... A42B 3/124 2/414
8,863,320 B2 10/2014 Kelly
8,950,735 B2 2/2015 Reynolds
9,066,551 B2 6/2015 Van Waes
9,131,744 B2 9/2015 Erb
2002/0017805 A1 2/2002 Carroll, III et al.
2002/0120978 A1 9/2002 Moore
2002/0152542 A1 10/2002 Dennis et al.
2002/0163114 A1 11/2002 Lobry
2002/0168496 A1 11/2002 Morimoto et al.
2003/0106138 A1 6/2003 Guay
2003/0200677 A1 10/2003 Abraham
2003/0217483 A1 11/2003 Abraham
2003/0230866 A1 12/2003 Lee
2004/0128860 A1 7/2004 Smaldone
2004/0139531 A1 7/2004 Moore et al.
2004/0154191 A1 8/2004 Park
2004/0188898 A1 9/2004 Siefermann et al.
2004/0199981 A1 10/2004 Tucker
2004/0200094 A1 10/2004 Baychar
2005/0050617 A1 3/2005 Moore et al.
2005/0060793 A1 3/2005 Rosie
2005/0166302 A1 8/2005 Dennis
2005/0196592 A1 9/2005 Tao et al.
2005/0210567 A1 9/2005 Rogers et al.
2005/0217006 A1 10/2005 Sutter
2005/0268383 A1 12/2005 Harris
2006/0059605 A1 3/2006 Ferrara
2006/0059606 A1 3/2006 Ferrara
2006/0064900 A1 3/2006 Aveni
2006/0070170 A1 4/2006 Copeland et al.
2006/0101559 A1 5/2006 Moore et al.
2006/0177635 A1 8/2006 Pepe et al.
2006/0195974 A1 9/2006 Burkhart et al.
2007/0000032 A1 1/2007 Morgan
2007/0083965 A1 4/2007 Darnell et al.
2007/0089219 A1 4/2007 Trainor et al.
2007/0190292 A1 8/2007 Ferrara
2007/0190293 A1 8/2007 Ferrara
2007/0281125 A1 12/2007 Moore, III et al.
2008/0035442 A1 2/2008 Spingler
2008/0036242 A1 2/2008 Glance et al.
2008/0155735 A1 7/2008 Ferrara
2008/0166524 A1 7/2008 Skaja et al.
2008/0236378 A1 10/2008 Sane et al.
2008/0256686 A1 10/2008 Ferrara
2008/0307568 A1 12/2008 Sajic
2009/0038055 A1 2/2009 Ferrara
2009/0049586 A1 2/2009 Wirthenstaetter
2009/0106882 A1 4/2009 Nimmons et al.
2009/0114083 A1 5/2009 Moore et al.
2009/0178184 A1 7/2009 Brine, III et al.
2009/0179361 A1 7/2009 Vito et al.
2009/0210998 A1 8/2009 Rolla
2009/0222975 A1 9/2009 Green et al.
2009/0265841 A1 10/2009 Ferrara
2009/0289026 A1 11/2009 Ferrara
2010/0000009 A1 1/2010 Morgan
2010/0037482 A1 2/2010 Litchfield et al.
2010/0129573 A1 5/2010 Kim
2010/0186150 A1 7/2010 Ferrara et al.
2010/0258988 A1 10/2010 Darnell et al.
2010/0264571 A1 10/2010 Tarazona De La Asuncion et al.
2010/0273944 A1 10/2010 Kobayashi et al.
2010/0295221 A1 11/2010 Kligerman et al.
2010/0295270 A1 11/2010 Marsden
2010/0299812 A1 12/2010 Maddux et al.
2010/0299813 A1 12/2010 Morgan
2011/0004971 A1 * 1/2011 Benderradji ..... A41D 23/00 2/84
2011/0047678 A1 3/2011 Barth et al.
2011/0047685 A1 3/2011 Ferrara
2011/0061154 A1 3/2011 Turner
2011/0074075 A1 3/2011 Henry et al.
2011/0107503 A1 5/2011 Morgan
2011/0131695 A1 6/2011 Maddux et al.
2011/0167542 A1 7/2011 Bayne et al.
2011/0198788 A1 8/2011 Hines
2011/0247744 A1 10/2011 Turner
2011/0277222 A1 11/2011 Garneau
2011/0296594 A1 12/2011 Thomas
2012/0017358 A1 1/2012 Princip
2012/0036620 A1 2/2012 Harris
2012/0060251 A1 3/2012 Schimpf
2012/0079646 A1 * 4/2012 Belanger ..... A42B 3/16 2/425

(56) References Cited

U.S. PATENT DOCUMENTS

| | | | |
|---|---|---|---|
| 2012/0174293 | A1 | 7/2012 | Milliren et al. |
| 2013/0152287 | A1 | 6/2013 | Cormier et al. |
| 2013/0153350 | A1 | 6/2013 | Ferrara |
| 2013/0239303 | A1 | 9/2013 | Cotterman et al. |
| 2014/0325745 | A1 | 11/2014 | Erb |

FOREIGN PATENT DOCUMENTS

| | | | |
|---|---|---|---|
| CA | 2681439 | | 11/2008 |
| CA | 2696242 | | 2/2009 |
| CN | 101227842 | | 7/2008 |
| CN | 101627222 | | 1/2010 |
| CN | 101707885 | | 5/2010 |
| CN | 101720999 | | 6/2010 |
| CN | 101873811 | | 10/2010 |
| EP | 0832572 | | 4/1998 |
| EP | 0926990 | | 7/1999 |
| EP | 1685019 | | 8/2006 |
| EP | 1848293 | | 10/2007 |
| EP | 1927294 | | 6/2008 |
| EP | 1937466 | | 7/2008 |
| EP | 1848293 | | 7/2009 |
| EP | 2092210 | | 8/2009 |
| EP | 2132516 | | 12/2009 |
| EP | 2146177 | | 1/2010 |
| EP | 2180802 | | 5/2010 |
| ES | 2330138 | | 12/2009 |
| FR | 2717659 | | 9/1995 |
| HK | 1112163 | | 11/2009 |
| JP | 54-148845 | | 11/1979 |
| JP | 2006188661 | A1 | 9/2010 |
| SU | 659134 | | 4/1979 |
| WO | 91/05489 | | 5/1991 |
| WO | 2006/005189 | | 1/2006 |
| WO | 2006022679 | | 3/2006 |
| WO | 2006/088500 | | 8/2006 |
| WO | 2006/089098 | | 8/2006 |
| WO | 2006/089235 | | 8/2006 |
| WO | 2007/035800 | | 3/2007 |
| WO | 2008011708 | | 1/2008 |
| WO | 2008/105840 | | 9/2008 |
| WO | 2008/140650 | | 11/2008 |
| WO | 2009/020583 | | 2/2009 |
| WO | 2009/134334 | | 11/2009 |
| WO | 2010/087957 | | 8/2010 |

OTHER PUBLICATIONS

The Messier Project: The M1 1 Helmet, 222.cascadeicehockey.com/the-helmet.html (2 pages) Jan. 19, 2010.

The Messier Project: the Technology, www.casecadeicehockey.com/the-technology.html, video slides of the Seven Technology, the video shows 80% compression (2 pages) Jan. 19, 2010.

Schutt Sports: Helmets—HotHead Technology, www.schuttsports.com/aspx/Sport/ProductCatalog.aspx7id-953 (1 page) Jan. 19, 2010.

Technology/SKYDEX, www.skydex.com/technology (3 pages) Jan. 19, 2010.

Blast Limiting/SKYDEX, www.skydex.com/technology/blast_limiting (7 pages) Jan. 19, 2010.

Impact Mitigation/SKYDEX, www.skydex.com/technology/impact_mitigation (7 pages) Jan. 19, 2010.

Manufacturing/SKYDEX, www.skydex.com/technology/manufacturing (2 pages) Jan. 19, 2010.

Development Process/SKYDEX, www.skydex.com/technology/development_process (2 pages) Jan. 19, 2010.

Selection Guide/SKYDEX, www.skydex.com/technology/selection_guide (3 pages) Jan. 19, 2010.

Patent Informaton/SKYDEX, 222.skydex.com/technology/patent (2 pages) Jan. 19, 2010.

Vs. Foam/SKYDEX, www.skydex.com/technology/vs_foam (1 page) Jan. 19, 2010.

Markets & Products/SKYDEX, www.skydex.com/markets_products (3 pages) Jan. 19, 2010.

Military Ballistic Helmet Pads/SKYDEX, www.skydex.com/helmet_pads (6 pages) Jan. 19, 2010.

Body Padding/SKYDEX, www. Wkydex.com/athletic/body_padding (1 page) Jan. 19, 2010.

International Search Report and Written Opinion for International Patent Application No. PCT/US1 1/38870 dated Oct. 26, 2011.

International Preliminary Report on Patentability for International Patent Application No. PCT/US1 138870 dated Dec. 4, 2012.

Search Report from European Patent Application No. 13844406.2 date Jul. 17, 2015.

Final Office Action from U.S. Appl. No. 14/524,675 dated Apr. 29, 2016.

International Search Report and Written Opinion from International Application No. PCT/US2013/063188 date of mailing Mar. 6, 2014.

International Search Report and Written Opinion from International Application No. PCT/US2014/062409 date of mailing Feb. 2, 2015.

Office Action from U.S. Appl. No. 14/524,675 dated Dec. 8, 2015.

International Search Report and Written Opinion from International Application No. PCT/US2012/059474 date of mailing Jan. 7, 2013.

Search Report from European Patent Application No. 13 844 406.2 dated Jun. 15, 2016.

Office Action from U.S. Appl. No. 13/777,270 dated Jun. 1, 2016.

Patent Translate Powered by EPO and Google, Description of Translation of JP2006188771, May 2016, Espacenet, pp. 1-15.

Patent Translate Powered by EPO and Google, Description of Abstract of JP2006188771, May 2016, Espacenet, p. 1.

Patent Translate Powered by EPO and Google, Description of Claims of JP2006188771, Jan. 2016, Espacenet, pp. 1-3.

Office Action from U.S. Appl. No. 14/524,675 dated Sep. 1, 2016.

Response to Office Action dated Apr. 29, 2016 from U.S. Appl. No. 14/524,675 dated Jul. 29, 2016.

International Search Report and Written Opinion from International Application No. PCT/US2011/038870 date of mailing Oct. 26, 2011.

* cited by examiner

HELMET IMPACT LINER SYSTEM

CROSS REFERENCE TO RELATED APPLICATION

This application is a U.S. Non-Provisional patent application which claims priority to U.S. Provisional Patent Application No. 61/503,822, filed on Jul. 1, 2011 and titled "Helmet Impact Liner System," which is hereby incorporated by reference in its entirety.

BACKGROUND

Helmets, such as sporting helmets, generally include a shell and a liner. The helmet shell generally provides protection from protruding objects and is often configured to spread the impact load across the footprint of the helmet. The helmet liner is generally made of a softer and lower density material than the helmet shell. The helmet liner is often configured such that, upon impact, the helmet liner at least partially absorbs the impact energy from the force of an impact.

SUMMARY

The present application discloses a helmet, an impact liner system for a helmet, an air channel insert for an impact liner, and an impact liner kit for a helmet.

For example, in one embodiment, a helmet comprising a helmet shell and an impact liner is disclosed. The impact liner is configured to be installed in the interior of the helmet shell to at least partially line the front, rear, and middle portions of the helmet shell. The impact liner comprises a front impact pad array, a middle impact pad array, and a rear impact pad array. Each impact pad array comprises a plurality of impact pads. The impact liner forms a plurality of air channels between the impact pads of the impact pad arrays when the impact liner is installed in the helmet shell. In certain embodiments, at least one insert is disposed within one or more of the plurality of air channels. The insert generally comprises a body portion having a top and vertical side walls configured to prohibit at least a portion of the air channel from collapsing when the helmet shell is installed on a user's head. Further, the helmet may include a plurality of comfort pads removably attached to the impact liner.

In another embodiment, an impact liner system is disclosed. The impact liner system comprises an impact liner configured to be installed in the interior of a helmet shell to at least partially line the front, rear, and middle portions of the helmet shell. The impact liner comprises a plurality of impact pads and forms a plurality of air channels between the impact pads when the impact liner is installed in the helmet shell. In certain embodiments, at least one insert is disposed within one or more of the plurality of air channels. The insert generally comprises a body portion having a top and vertical side walls configured to prohibit at least a portion of the air channel from collapsing when the helmet shell is installed on a user's head. Further, the impact liner system may include a plurality of comfort pads configured to be removably attached to the impact liner.

In yet another embodiment, an impact liner kit for a helmet shell is disclosed. The kit comprises an impact liner and at least one insert. The impact liner is configured to be installed in the interior of a helmet shell and comprises a front impact pad array, a middle impact pad array, and a rear impact pad array. Each impact pad array comprises a plurality of impact pads. The impact liner forms a plurality of air channels between the impact pads of the impact pad arrays when the impact liner is installed in the helmet shell. The at least one insert is configured to be installed within one or more of the plurality of air channels. The insert comprises a body portion having a top and vertical side walls configured to prohibit at least a portion of the air channel from collapsing when the helmet shell is installed on a user's head. In certain embodiments, the kit may include one or more comfort pads configured to be removably attached to the impact liner.

While the drawings herein are to relative scale, it is within the disclosure of this specification to vary the relative size of components to one another.

DESCRIPTION OF EMBODIMENTS

The present application discloses a helmet, an impact liner system for a helmet, an air channel insert for an impact liner, and an impact liner kit for a helmet. In the embodiments disclosed herein, the impact liner system of the present application is described for use with a helmet configured to protect the head of the user. Exemplary helmets may include, but are not limited to, military helmets, sporting helmets, such as football, lacrosse, hockey, multisport, cycling, softball, or baseball helmets, or safety helmets, such as industrial or construction helmets.

The impact liner system of the present application is configured to attach to the interior of the helmet shell and may be positioned between the user's head and the helmet shell. The impact liner system comprises one or more pads that absorb and/or dissipate the impact energy from the force of an impact. The one or more pads may deform or crush upon impact and consume a portion of the impact energy such that it does not reach the user's head. The one or more pads may also dissipate the impact force over a larger surface area than the actual area of impact so that the force per unit area is decreased for the head compared to that for the initial impact surface (e.g., the outer surface of the helmet shell).

The impact liner system generally comprises an impact liner configured to line the front, rear, and middle portions of the interior of a helmet. The impact liner includes one or more impact pads and air channels for routing external air between the impact pads. Further, the impact liner system may include one or more inserts positioned in the one or more air channels. The impact liner system may also include one or more comfort pads attached to the impact liner, such as, for example, at the front and rear portions of the impact liner.

Figure 1A:
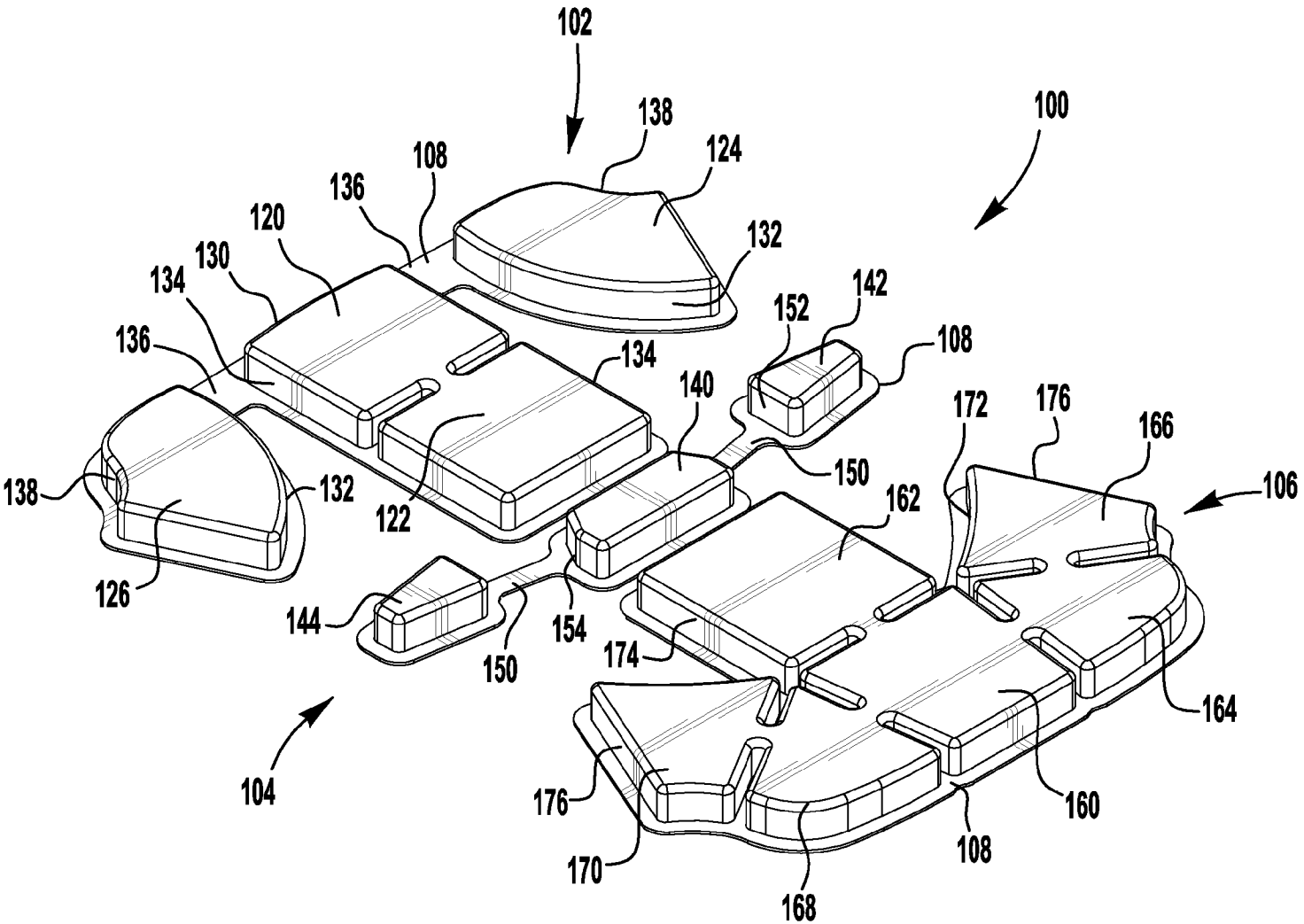
FIGS. 1A and 1B are perspective and top plan views, respectively, of an impact liner according to an embodiment of the present application.
Figure 1B:
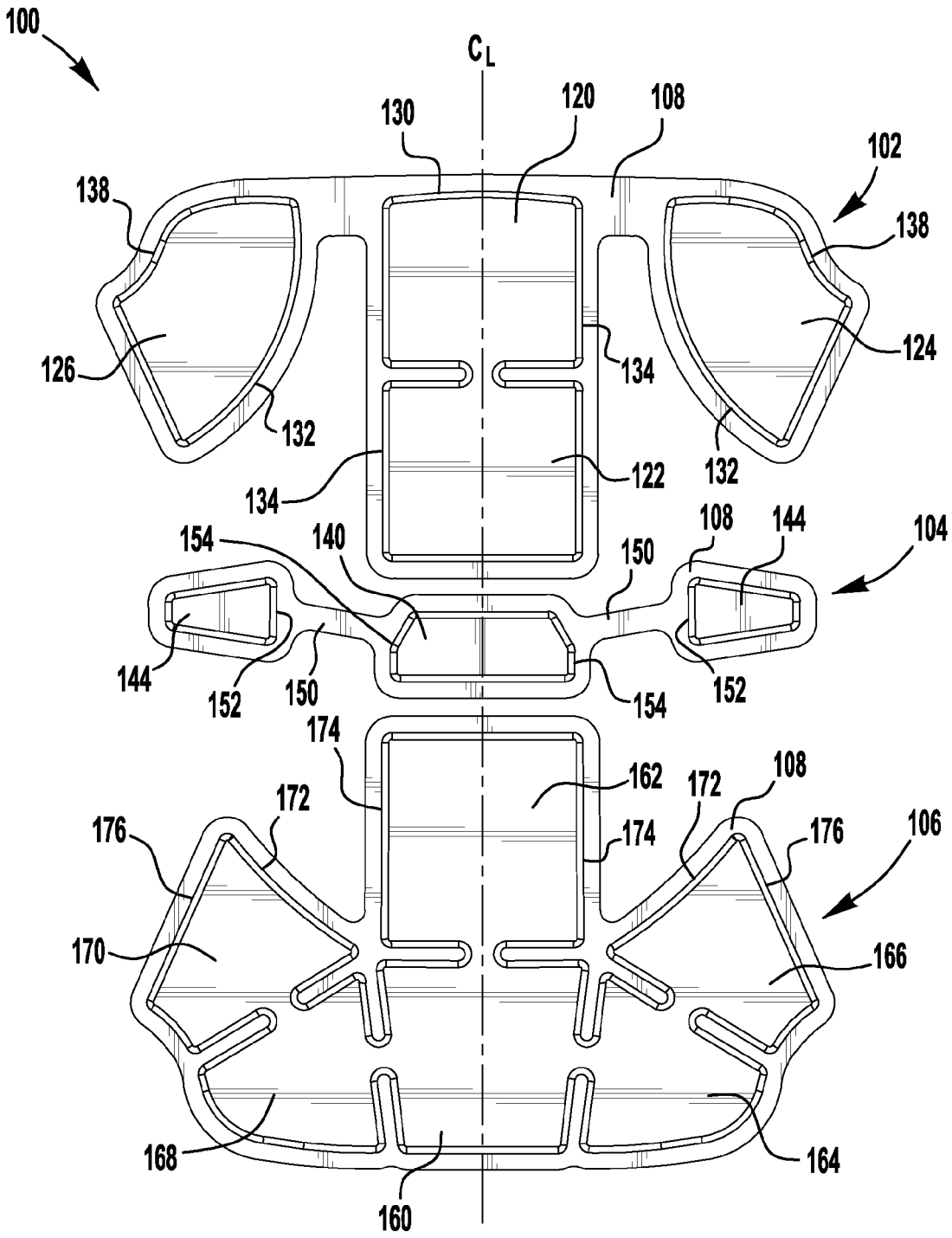

FIGS. 1A and 1B illustrates an impact liner 100 of an impact liner system according to an embodiment of the present application. As illustrated, the impact liner 100 includes an array of front impact pads 102, middle impact pads 104, and rear impact pads 106. The impact pad arrays may be configured in a variety of sizes and dimensions to accommodate a range of head sizes. Further, the impact pad arrays may be connected together to form a unitary component of impact pads.

Each impact pad array comprises one or more impact pads encased in a liner material 108. The liner material 108 holds the impact pads in relative position to one another and also attaches the impact pads together. The impact pads and the liner material 108 are flexible such that the array of impact pads may be formed within the interior of a helmet shell. As such, the impact pad arrays are capable of being folded to substantially conform to the shape of the interior of a helmet shell.

As illustrated in FIG. 1B, each impact pad array is substantially disposed about a centerline $C_L$ of the impact liner 100. As such, in this embodiment, each impact pad array possesses a geometry on one side of the centerline $C_L$ that is a mirror image of the geometry on the other side of the centerline $C_L$.

In certain embodiments, the impact pads of impact liner 100 comprise a flexible and resilient polyurethane foam having an average density between about 3.0 and 12.0 lbs/ft$^3$ and an average thickness between about 0.325 and 1.0 inch. For example, in one embodiment, the impact pads comprise a polyurethane foam having an average density of about 4.0 lbs/ft$^3$ and an average thickness of about 0.5 inches. One example of such a polyurethane foam is Zorbium™ Foam from Team Wendy, LLC. However, the impact pads may comprise a variety of other types of foam or other materials, such as, for example, expanded polypropylene, expanded polystyrene, vinyl nitrile, ethylene-vinyl acetate (EVA), open or closed cell cross linked foams, and molded polymer structures such as thermoplastic urethane (TPU). Further, any one or more of the impact pads may comprise a different type of material than another impact pad. For example, softer and/or thicker impact pads may be positioned toward the front of the helmet shell and more rigid and/or thinner impact pads may be positioned toward the top and/or rear of the helmet shell.

In certain embodiments, the liner material 108 comprises a "loop" fabric capable of attaching to the hook portion of a piece of Velcro®. As described below and shown in FIGS. 6 and 7, comfort pads may be attached to the impact liner 100. The comfort pads may include the hook portion of a piece of Velcro® that attaches to the liner material 108. In one embodiment, the liner material 108 comprises a nylon loop fabric from Guilford Performance Textiles. However, the liner material 108 may comprise a variety of other types of materials and fabrics. Further, the liner material 108 may comprise a "hook" fabric capable of attaching to the loop portion of a piece of Velcro®.

In one embodiment, the liner material 108 comprises a top portion and bottom portion. The top portion of the liner material is heat sealed to the bottom portion around the impact pads such that the impact pads are held in relative position to one another. Further, as described below, the portions of the liner material between one or more of the impact pads may form a portion of an air channel when the impact pads are installed in a helmet shell.

As illustrated in FIGS. 1A and 1B, the front impact pad array 102 comprises a first central pad 120, a second central pad 122, a left pad 124, and a right pad 126. As shown, the central pads 120 and 122 of the front impact pad array 102 are rectangular in shape. The middle impact pad array 104 comprises a central pad 140, a left pad 142, and a right pad 144. The rear impact pad array 106 comprises a first central pad 160, a second central pad 162, a left rear pad 164, a left front pad 166, a right rear pad 168, and a right front pad 170. As shown, the first central pad 160 of the rear impact pad array 106 is trapezoidal in shape and the second central pad 162 is rectangular in shape.

Figure 2A:
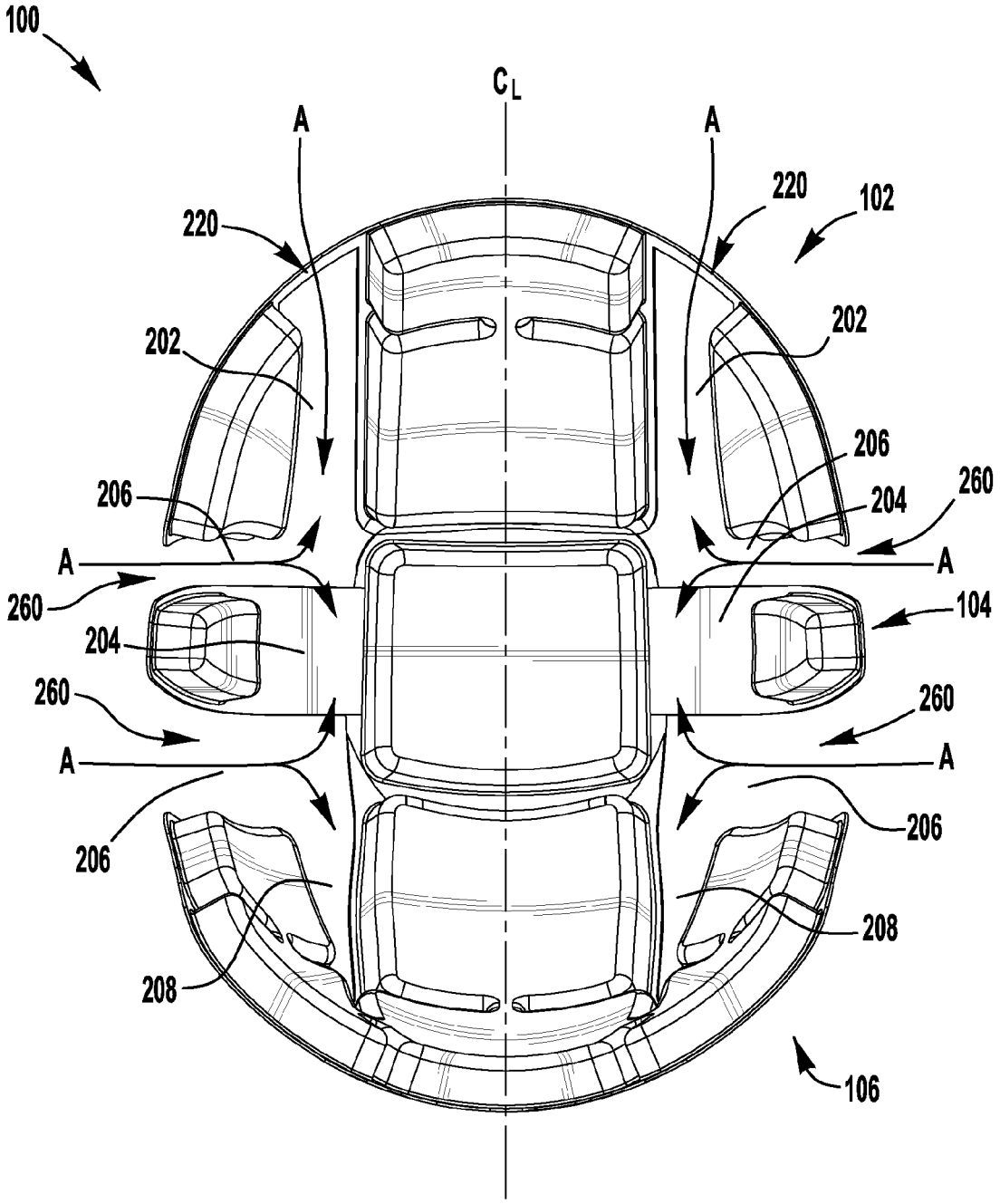
FIG. 2A is a top plan view of an impact liner in a folded configuration to be installed in a helmet shell according to an embodiment of the present application.
Figure 2B:
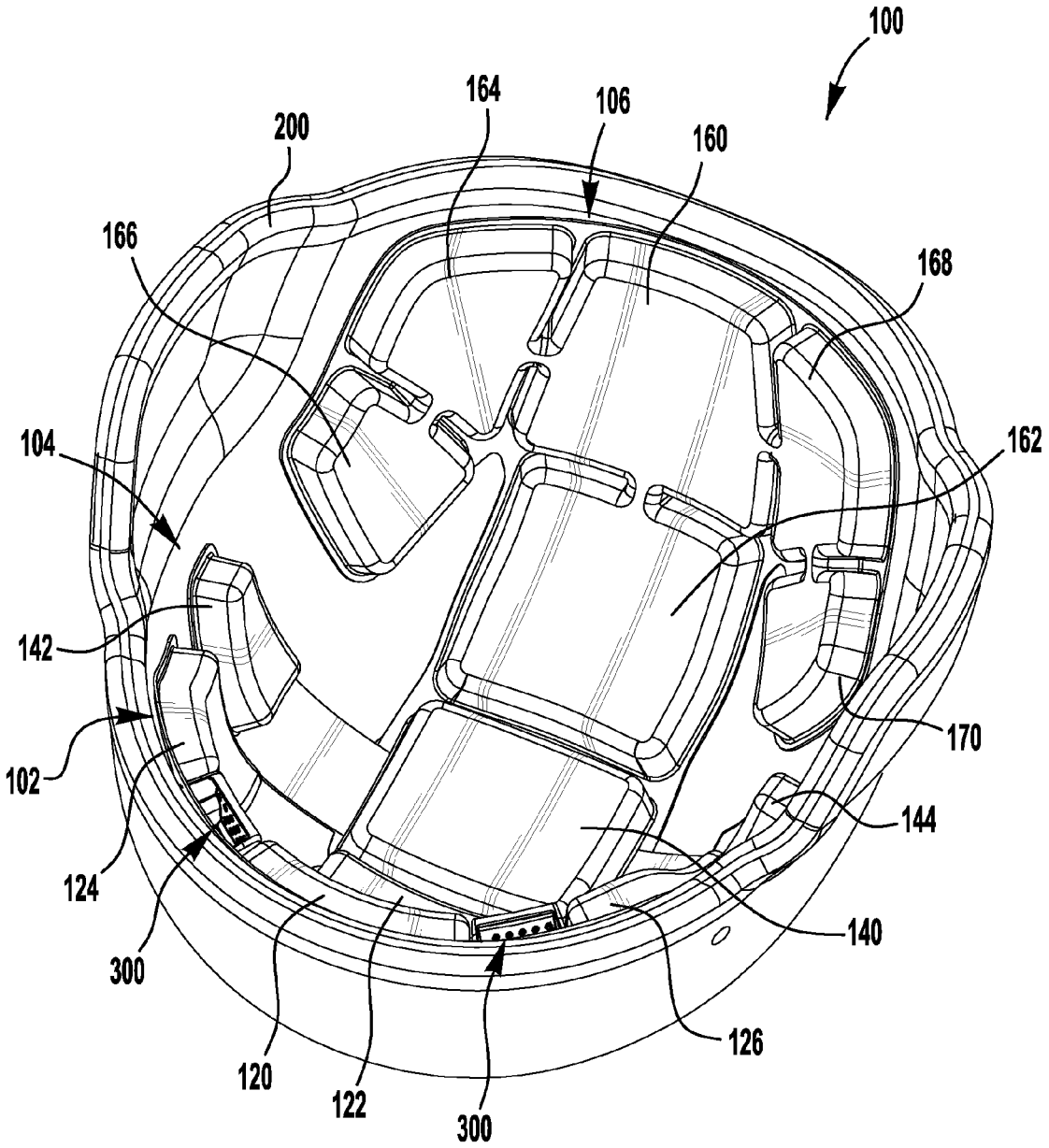
FIGS. 2B and 2C are perspective views of the impact liner of FIG. 2A installed in a helmet shell according to an embodiment of the present application.
Figure 2C:
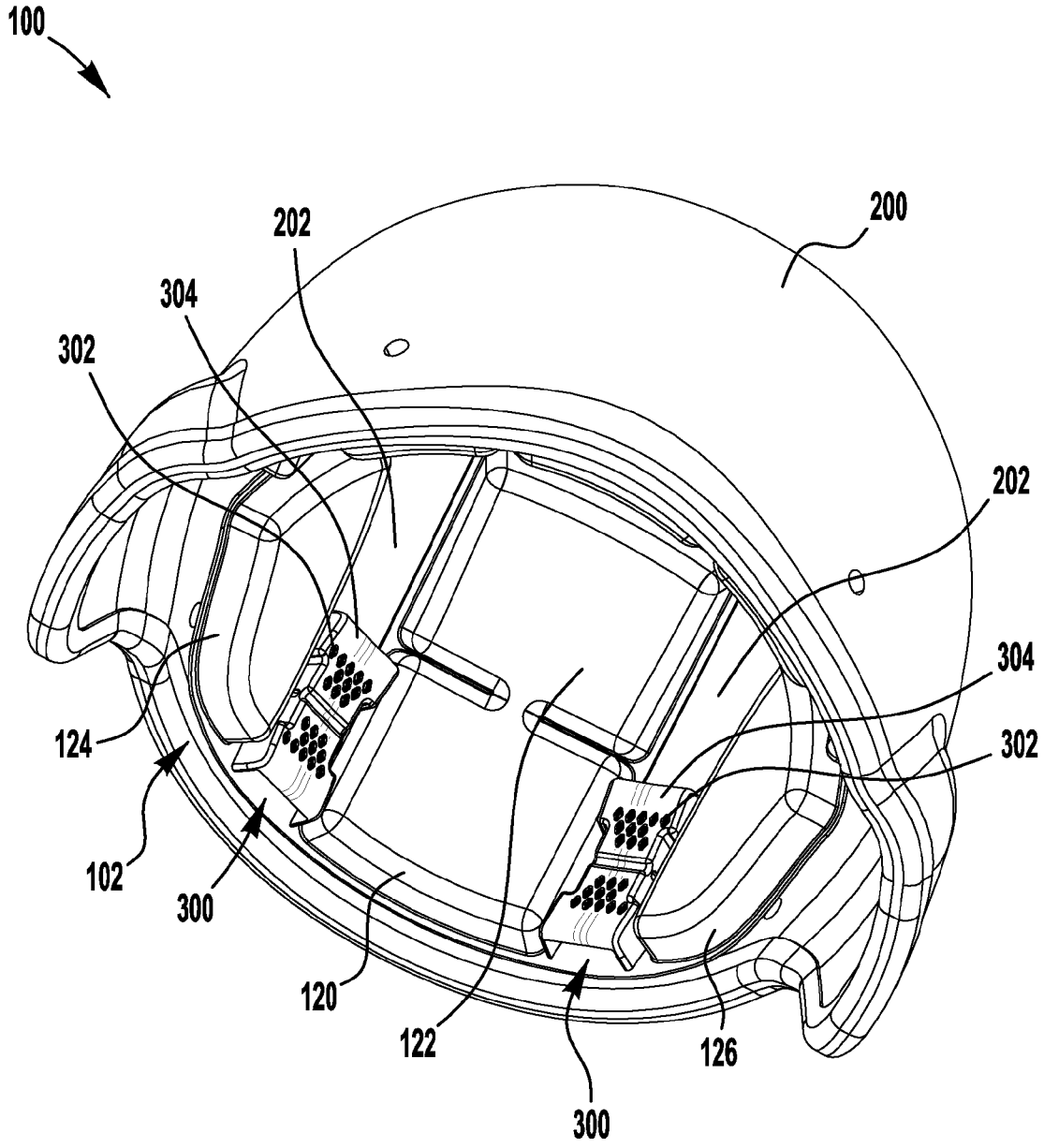

FIG. 2A illustrates the impact liner 100 of the impact liner system in a folded configuration to be installed in a helmet shell. FIGS. 2B and 2C illustrate the impact liner 100 of the impact liner system installed in a helmet shell 200. As shown, the front impact pad array 102 is installed on the front, sides, and top of the helmet shell 200; the middle impact pad array 104 is installed on the sides and top of the helmet shell; and the rear impact pad array 106 is installed on the rear, sides, and top of the helmet shell.

The impact liner 100 may be installed on the interior of the helmet shell 200 in a variety of ways, such as, for example, with one or more fasteners, adhesive, clips, pins, snaps, tape, buckles, Velcro®, or a hook and loop. For example, in one embodiment, the impact liner 100 is installed with one or more pieces of Velcro® to the interior of the helmet shell 200. In another embodiment, the liner material 108 of the impact liner 100 is attached to the helmet shell 200 by tabs that are bolted or otherwise attached at a chinstrap mounting point, such as, for example, with a bolt that goes through the helmet shell to attach the chinstrap as well as the impact liner to the helmet shell. In another embodiment, the liner material 108 of the impact liner 100 is attached to the helmet shell 200 with snaps, e.g., snaps attached to the front, rear, and central portions of the impact liner.

As illustrated in FIGS. 2B and 2C, the first central pad 120 of the front impact pad array 102 is installed on the front of the helmet shell 200 and is configured to protect the forehead of the user; the second central pad 122 is installed on the front top portion of the helmet shell and is configured to protect the front portion of the user's head above the forehead; and the left and right pads 124 and 126 are installed on the front left and front right portions of the helmet shell and are configured to protect the front left and front right portions of the user's head.

As illustrated in FIGS. 1A and 1B, the first central pad 120 of the front impact pad array 102 comprises a curved edge 130 that provides added coverage (e.g., relative to a straight edge) when the first central pad is bent around the front interior radius of the helmet shell 200. Further, the left and right pads 124 and 126 of the front impact array 102 comprise a first curved edge 132 that forms a portion of front air channels 202 when the impact liner 100 is installed in the helmet shell 200. The left and right pads 124 and 126 of the front impact array 202 also comprise a second curved edge 138 configured such that, when the impact liner 100 is installed in the helmet shell 202, the left and right pads do not cover the ears of the user.

As illustrated in FIG. 2A, the front air channels 202 are formed between the first curved edge 132 of the left and right pads 124 and 126, the longitudinal edges 134 of the central pads 120 and 122, the portion 136 of the liner material 108 between the first central pad 120 and the left and right pads, and the interior of the helmet shell 200. Further, the front air channels 202 have openings 220 at the front of the helmet shell 200. These openings 220 permit external air A to enter the front air channels 202 and permit air from inside the helmet shell 200 to escape to the outside.

As illustrated in FIGS. 2B and 2C, the central pad 140 of the middle impact pad array 104 is installed on the middle top portion of the helmet shell 200 between the second central pads 122 and 162 of the front and rear impact pad arrays 102 and 106 and is configured to protect the top of the user's head. The left and right pads 142 and 144 of the middle impact pad array 104 are installed on the middle left and middle right portions of the helmet shell 200 and are configured to protect the left and right portions of the user's head above the ears. The left pad 142 of the middle impact pad array 104 is installed between the left pad 124 of the front impact pad array 102 and the left front pad 166 of the rear impact pad array 106. The right pad 144 of the middle impact pad array 104 is installed between the right pad 126 of the front impact pad array 102 and the right front pad 170 of the rear impact pad array 106.

As illustrated in FIG. 2A, the portion 150 of the liner material 108 between the central pad 140 and left and right pads 142 and 144 of the middle impact pad array 104 form a portion of middle air channels 204 when installed in the helmet shell 200. The middle air channels 204 are formed between edges 152 of the left and right pads 142 and 144, edges 154 of the central pad 140, the portion 150 of the liner material 108 between the central pad and the left and right pads, and the interior of the helmet shell 200. The middle air channels 204 are substantially aligned with the front air channels 202. In one embodiment, when the impact liner 100 is installed in the helmet shell 200, the front and middle air channels 202 and 204 are substantially parallel to a centerline $C_L$ of the folded impact liner 100 (as shown in FIG. 2A).

Further, as illustrated in FIG. 2A, when the impact liner 100 is installed in the helmet shell 200, the gap between the pads of the middle impact pad array 104 and the pads of the front and rear impact pad arrays 102 and 106 form transverse air channels 206 that are substantially perpendicular to the centerline $C_L$ of the folded impact liner 100. As illustrated in FIG. 2A, the transverse air channels 206 are in fluid communication with the front and middle air channels 202 and 204. Further, the transverse air channels 206 have openings 260 above the ear portion of the helmet shell 200. These openings 260 permit external air A to enter the transverse air channels 206 and permit air from inside the helmet shell 200 to escape to the outside.

As illustrated in FIGS. 2B and 2C, the first central pad 160 of the rear impact pad array 106 is installed on the rear of the helmet shell 200 and is configured to protect the rear of the user's head; the second central pad 162 is installed on the rear top portion of the helmet shell and is configured to protect the rear top portion of the user's head (e.g., the crown of the head); the left and right rear pads 164 and 168 are installed on the rear left and rear right of the helmet shell and are configured to protect the rear left and rear right portions of the user's head; the left front pad 166 is installed on the left and rear left top portions of the helmet shell and is configured to protect the left and rear left top portions of the user's head (e.g., above and behind the user's left ear); and the right front pad 170 is installed on the right and rear right top portions of the helmet shell and is configured to protect the right and rear right top portions of the user's head (e.g., above and behind the user's right ear).

Further, the left and right front pads 166 and 170 of the rear impact pad array 106 comprise a first curved edge 172 that forms a portion of rear air channels 208 when the impact liner 100 installed in the helmet shell 200. As illustrated in FIG. 2A, the rear air channels 208 are formed between the first curved edges 172 of the left and right front pads 166 and 170, the longitudinal edges 174 of the second central pad 162, and the interior of the helmet shell 200. The rear air channels 208 are in fluid communication with the front, middle, and transverse air channels 202, 204, and 206. Further, the left and right front pads 166 and 170 and the left and right rear pads 164 and 168 of the rear impact pad array 106 comprise a second curved edge 176 configured such that, when the impact liner 100 installed in the helmet shell 200, the pads do not cover the ears of the user.

When the impact liner 100 is installed in the helmet shell 200, the front, middle, and rear impact pad arrays 102, 104, and 106 of the impact liner collectively cover between about 50% and 100% of the interior surface area of a helmet shell. For example, in a preferred embodiment, the front, middle, and rear impact pad arrays 102, 104, and 106 of the impact liner 100 are shaped and configured to cover the interior surface of a military helmet shell to protect the head of the user. Examples of such military helmet shells include a US Army Advanced Combat Helmet (ACH), a US Marine Corp Lightweight Helmet, an Enhanced Combat Helmet (ECH), a Personal Armor System for Ground Troops (PASGT) helmet, or other typical ballistic helmet shells. In one embodiment, the front, middle, and rear impact pad arrays 102, 104, and 106 of the impact liner 100 collectively cover about 80% of the interior surface area of a military helmet shell.

Further, when the impact liner 100 is installed in a helmet shell 200, the impact liner forms a ventilation system configured to cool the user's head. As illustrated in FIG. 2A, the ventilation system comprises the front, middle, transverse, and rear air channels 202, 204, 206, and 208, which collectively form a network of air channels. Further, gaps between the various pads of the impact pad arrays form air channels that fluidly communicate with the front, middle, transverse, and rear air channels 202, 204, 206, and 208 and form a portion of the network of air channels. The ventilation system is configured such that external air is permitted to flow through front and transverse air channel openings 220 and 260 and throughout the network of air channels. When the user's head is placed against the pads of the impact liner 100, the air in the network of air channels flows over the user's head to cool the user's head. Further, air within the helmet shell 200 (e.g., heated air) is permitted to escape out the front and transverse air channel openings 220 and 260 through the network of air channels.

FIGS. 2B and 2C illustrate the impact liner 100 of the impact liner system installed in the helmet shell 200 and including air channel inserts 300 according to an embodiment of the present application. As illustrated, the air channel inserts 300 are positioned in the front air channels 202 of the impact liner 100. However, the air channel inserts 300 may be positioned in any one or more of the air channels of the impact liner 100 and at any location within the air channel. Further, the air channel insert 300 may be made of a variety of materials, such as, for example, thermoplastic urethane (TPU), polypropylene, polyethylene, ABS plastic, rubber, or ethylene propylene diene Monomer (M-class) rubber (EPDM). In a preferred embodiment, the air channel insert 300 is an injected molded piece of Texin® TPU.

The air channel inserts 300 are configured to prohibit at least a portion of the air channels from collapsing when the helmet is installed on the user's head. For example, any one or more edges of an impact pad may collapse into the air channel when the user's head (e.g., the user's forehead) is pressed against the impact pad. The air channel insert 300 is configured with vertical walls that prohibit one or more edges of the impact pads from collapsing into the air channel. As such, the air channel remains open such that air is permitted to flow through the network of air channels of the impact liner 100.

Openings 302 in the top 304 of the air channel insert 300 permit the air flowing through the air channel insert to flow over the portion of the user's head that is adjacent to the top of the insert. Further, the air channel insert 300 may be flexible, or comprise features that permit the insert to flex, such that it may be bent to conform to the curvature of the interior of the helmet shell 200. Further, portions of the air channel insert 300 may be configured to attach the insert to the impact liner 100 (e.g., to the liner material) and/or to the helmet shell 200.

Figure 3A:
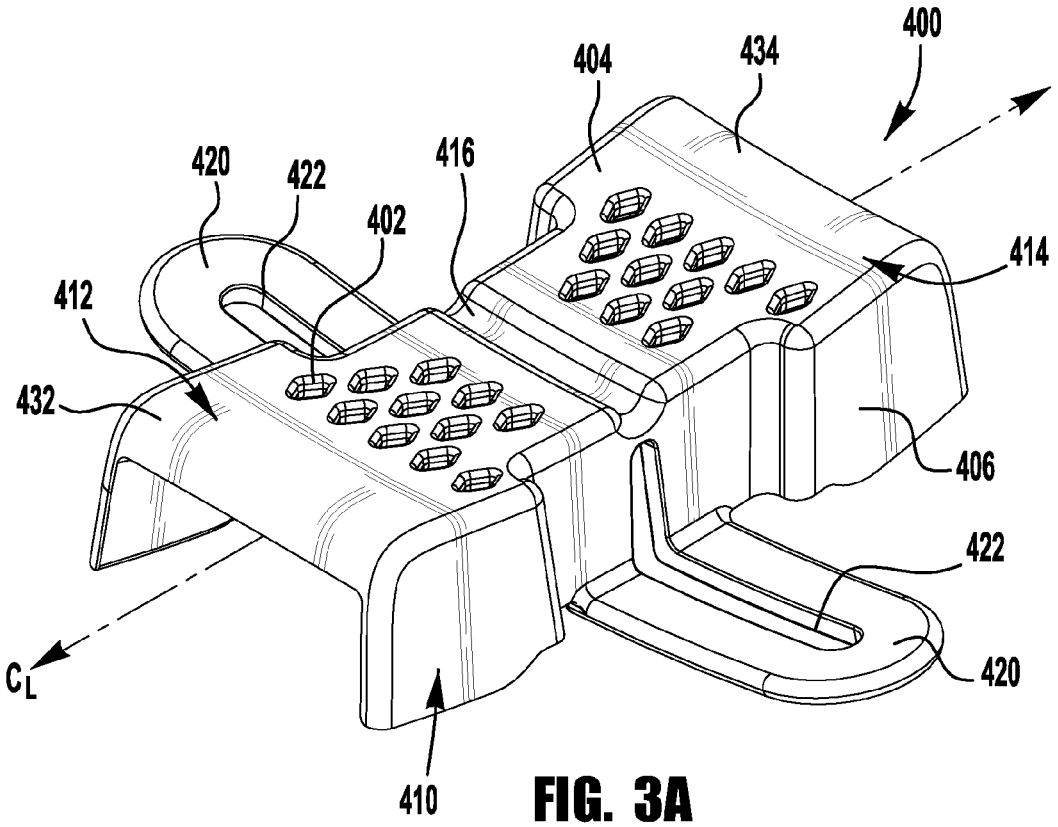
FIGS. 3A and 3B are perspective and side elevation views, respectively, of an air channel insert according to an embodiment of the present application.
Figure 3B:
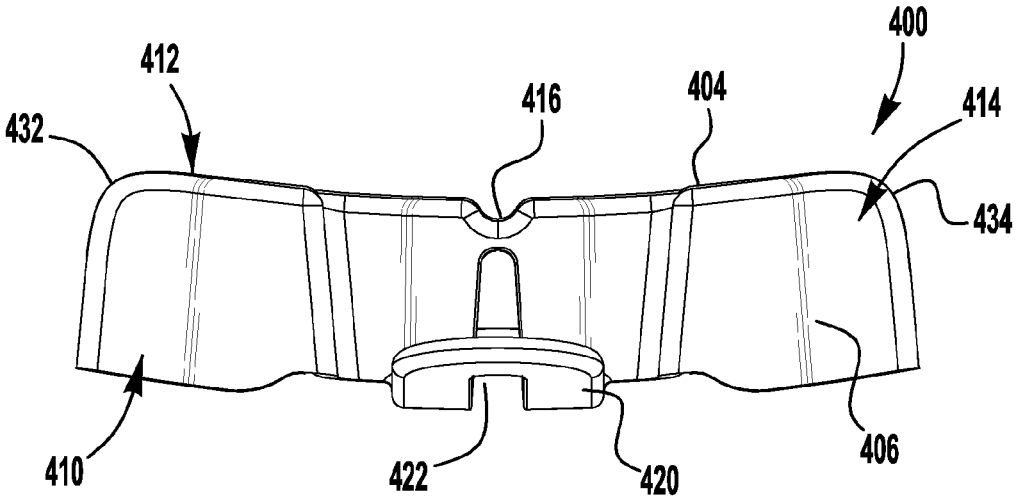

FIGS. 3A and 3B illustrate an air channel insert 400 according to an embodiment of the present application. As shown, the air channel insert 400 includes a body portion 410 having a top 404 and vertical side walls 406 disposed about a centerline $C_L$ of the insert.

Openings 402 in the top 404 of the body portion 410 permit the air flowing through the air channel insert 400 to flow over the portion of the user's head that is adjacent to the top of the insert. As illustrated in FIG. 3B, the body portion 410 of the air channel insert 400 may also be curved such that it conforms to the curvature of the interior of the helmet shell 200 and/or the curvature of the impact liner 100. Further, the vertical side walls 406 of the body portion 410 are configured prohibit one or more edges of the impact pads from collapsing into the air channel. As such, the air channel insert 400 is configured to be positioned within an air channel such that the vertical side walls 406 are adjacent one or more edges of the impact pads.

As illustrated in FIGS. 3A and 3B, the body portion 410 of the air channel insert 400 includes a first portion 412 and a second portion 414 connected together by a thin piece of material 416 that acts as a flexible membrane or hinge. The thin piece of material 416 is substantially perpendicular to the centerline $C_L$ of the insert 400. The thin piece of material 416 permits the first portion 412 to move or flex relative to the second portion 414 such that the air channel insert 400 may be bent to conform to the curvature of the interior of the helmet shell 200. In other embodiments, the thin piece of material 416 may be located at a variety of locations on the insert 400. For example, the thin piece of material 416 may be substantially parallel to the centerline $C_L$ of the insert 400 to permit bending of the insert about the centerline.

Further, attachment members 420, or flanges, extend outward from the body portion 410 of the insert 400. As shown, each attachment member 420 extends substantially perpendicular to the centerline $C_L$ of the insert 400 and includes a slot 422. The slot 422 of each attachment member 420 is substantially perpendicular to the centerline $C_L$ of the insert 400 and substantially aligned with the thin piece of material 416. As such, the slot 422 in each attachment member 420 facilitates bending of the first portion 412 of the insert 400 relative to the second portion 414. Further, a fastener, such as, for example, a screw, rivet, pin, clip, snap, hook and loop, or the like, may be received in the slot 422 to couple the air channel insert 400 to the impact liner 100 and/or the helmet shell 200. The air channel insert 400, such as one or more attachment members 420 of the insert, may also include an indicator to indicate proper positioning of the air channel insert (e.g., an F arrow indicator which indicates the direction toward the front of the helmet).

Figure 3C:
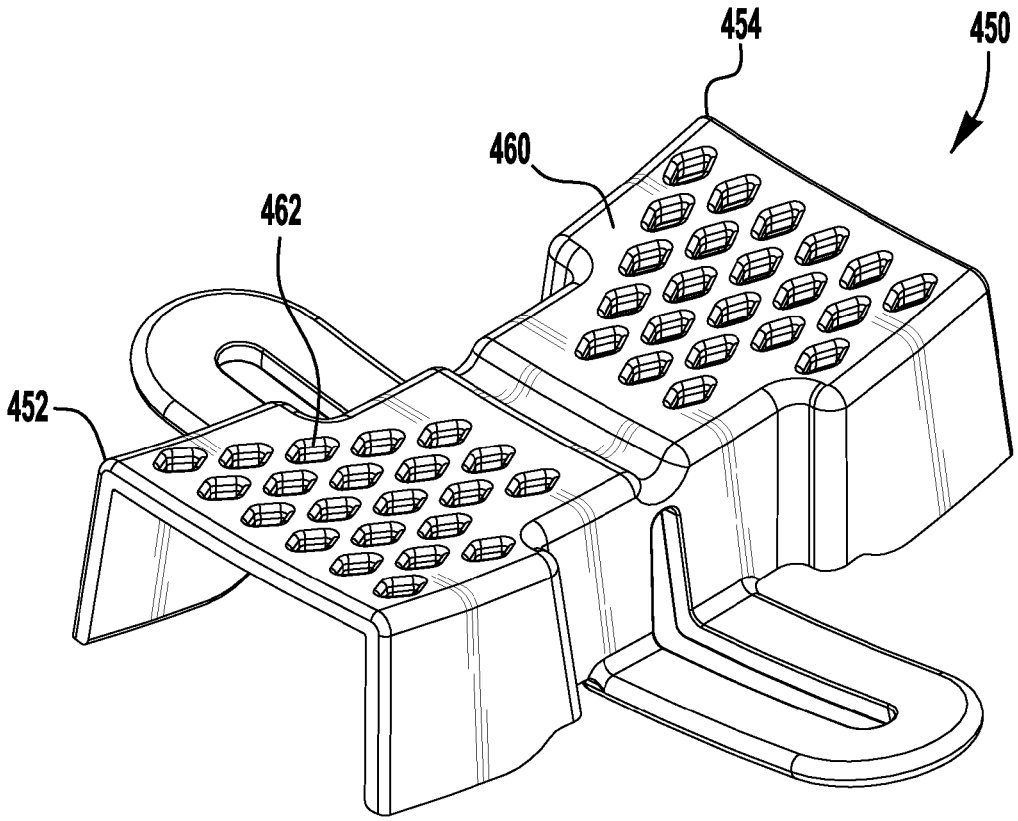
FIGS. 3C and 3D are perspective and side elevation views, respectively, of an air channel insert according to an embodiment of the present application.
Figure 3D:
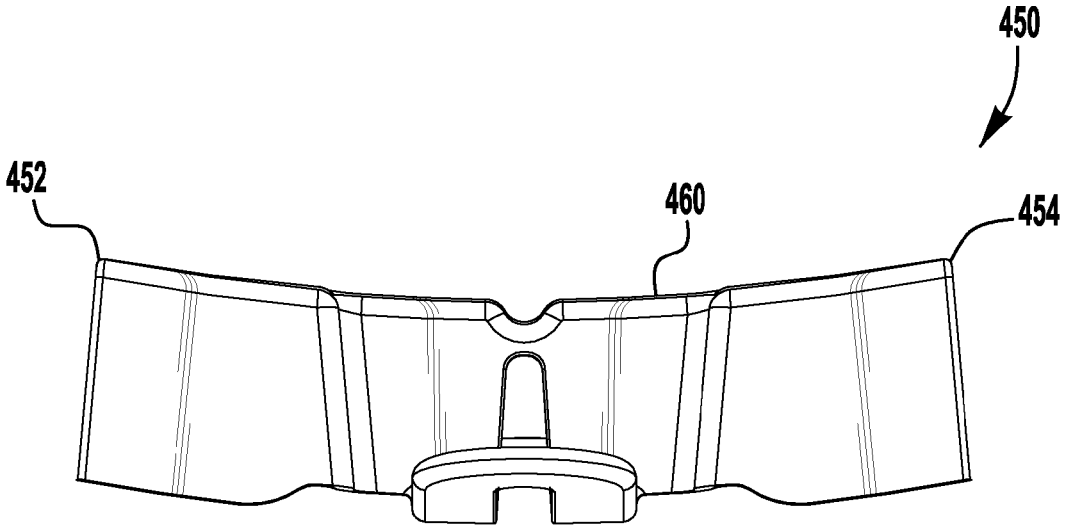

As illustrated in FIGS. 3A and 3B, the leading and trailing edges 432 and 434 of the top 404 of the air channel insert 400 are rounded to provide more comfort to the user when the insert rests against the user's head and prohibit the edges from catching on or tearing the impact liner 100. However, in other embodiments, the edges 432 and 434 may or may not be rounded. For example, FIGS. 3C and 3D illustrate an air channel insert 450 according to another embodiment of the present application. The air channel insert 450 is similar to the air channel insert 400 shown in FIGS. 3A and 3B. However, the leading and trailing edges 452 and 454 of the top 460 of the air channel insert 450 are not rounded. Further, the top 460 of the air channel insert 450 includes less openings 462 than the top 404 of the air channel insert 400 illustrated in FIGS. 3A and 3B.

Figure 4:
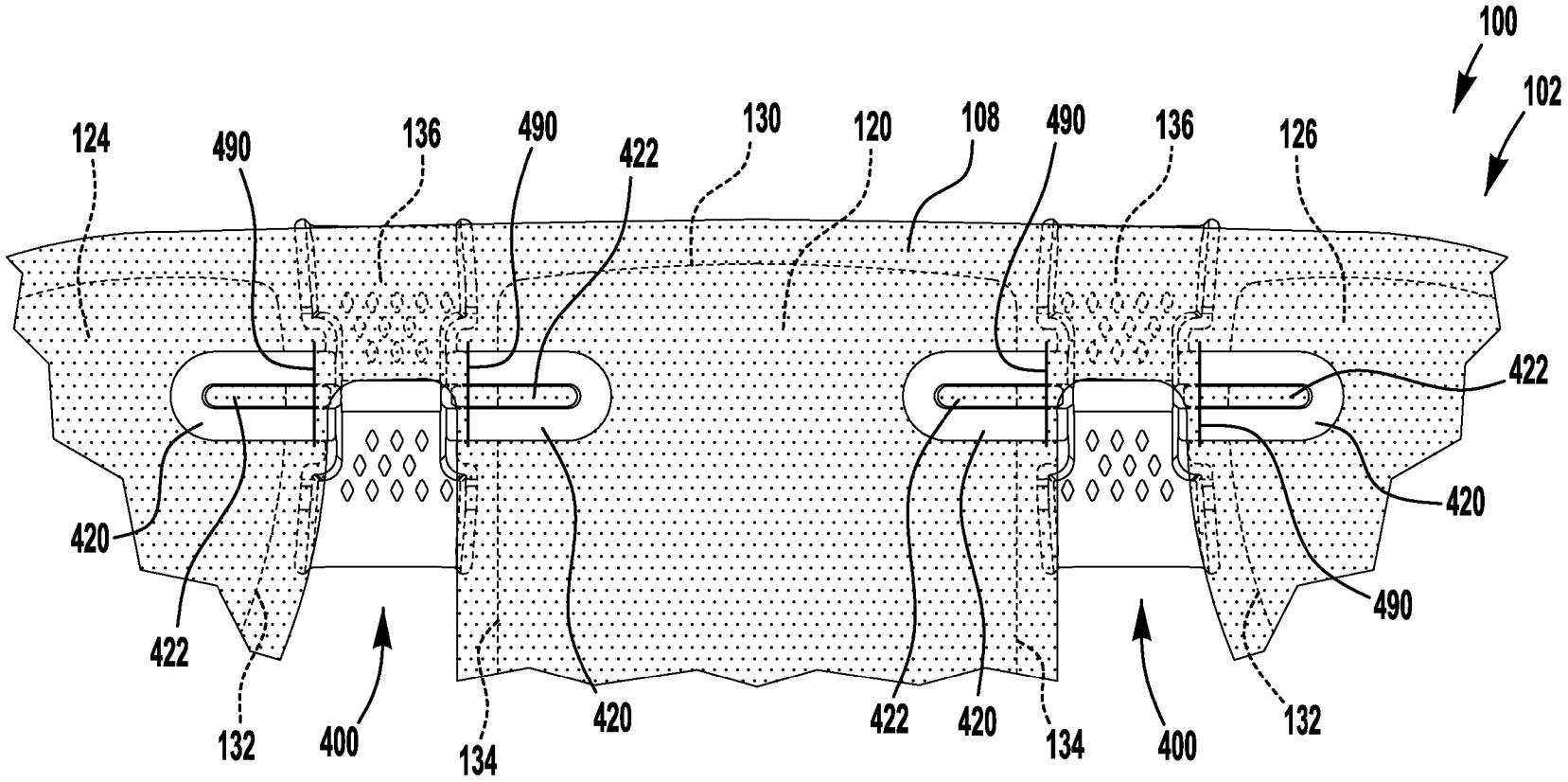
FIG. 4 is a partial bottom plan view of an impact liner and air channel inserts according to an embodiment of the present application.

In certain embodiments, an air channel insert may be attached to the liner material of the impact liner. For example, FIG. 4 is a partial bottom view of the front impact pad array 102 of the impact liner 100. As illustrated in this embodiment, air channel inserts 400 are disposed within the front air channels 202 of the impact liner 100. The portions 136 of the liner material 108 that at least partially form the front air channels 202 comprise slits 490 sized and configured to receive the attachment members 420 of the air channel inserts 400. The attachment members 420 of the air channel inserts 400 are inserted through the slits 490 such that the insert is held in place relative to the liner material 108. In some embodiments, a fastener, such as, for example, a screw, rivet, pin, clip, snap, hook and loop, or the like, may be received in one or more slots 422 of the engagement members 420 to couple the air channel inserts 400 to the liner material 108. Further, it is contemplated that an air channel insert may be attached to the liner material 108 in any one or more of the air channels of the impact liner 100 and at any location within the air channel.

One or more comfort pads may be attached to the impact liner of the impact liner system. In certain embodiments, the comfort pads may be up to about ⅜" thick. For example, in one embodiment, ⅛" and/or ¼" thick comfort pads are attached to the impact liner of the impact liner system. Various sized comfort pads may be used to adjust the sizing and fit of the helmet on the user's head. Further, the comfort pads may be a variety of shapes and sizes and may be positioned and/or configured in a variety of ways to comfort various portions of the user's head.

The comfort pads may include a soft cushion material, such as a foam, encased in a fabric material. In certain embodiments, the comfort pads comprise a flexible and resilient polyurethane foam having an average density between about 3.0 and 12.0 lbs/ft$^3$. For example, in one embodiment, the comfort pads comprise a polyurethane foam having an average density of 4.0 lbs/ft$^3$ and the thickness of the polyurethane foam is about 0.1875 inch. One example of such a polyurethane foam is Zorbium™ Foam from Team Wendy, LLC. However, the comfort pads may comprise a variety of other types of foam or other materials, such as, for example, expanded polypropylene, expanded polystyrene, vinyl nitrile, and molded polymer structures such as thermoplastic urethane (TPU). Further, any one or more of the comfort pads may comprise a different type of material than another comfort pad.

The fabric material of the comfort pads may be a variety of fabric materials. For example, in one embodiment, the comfort pads comprise an Ultrasuede® fabric material. Further, the comfort pads may be water resistant. For example, the comfort pads may include a wicking fabric, such as polyester, nylon, or spandex. In one embodiment, the wicking fabric is GameTime Antimicrobial Wicking Fabric. In other embodiments, however, the comfort pads are moisture absorbent to absorb perspiration from the user's head. Further, in certain embodiments, the comfort pads comprise a fabric material only and do not include a foam portion.

The comfort pads are configured to be removably attached to the impact liner. For example, in one embodiment, the comfort pads are removably attached to the liner material of the impact liner with Velcro®. As described above, the comfort pads may include the hook portion of a piece of Velcro® that attaches to a loop fabric of the liner material. However, a variety of other methods of attachment may be used, such as, for example, with one or more fasteners, adhesive, clips, pins, snaps, tape, or buckles.

Figure 5:
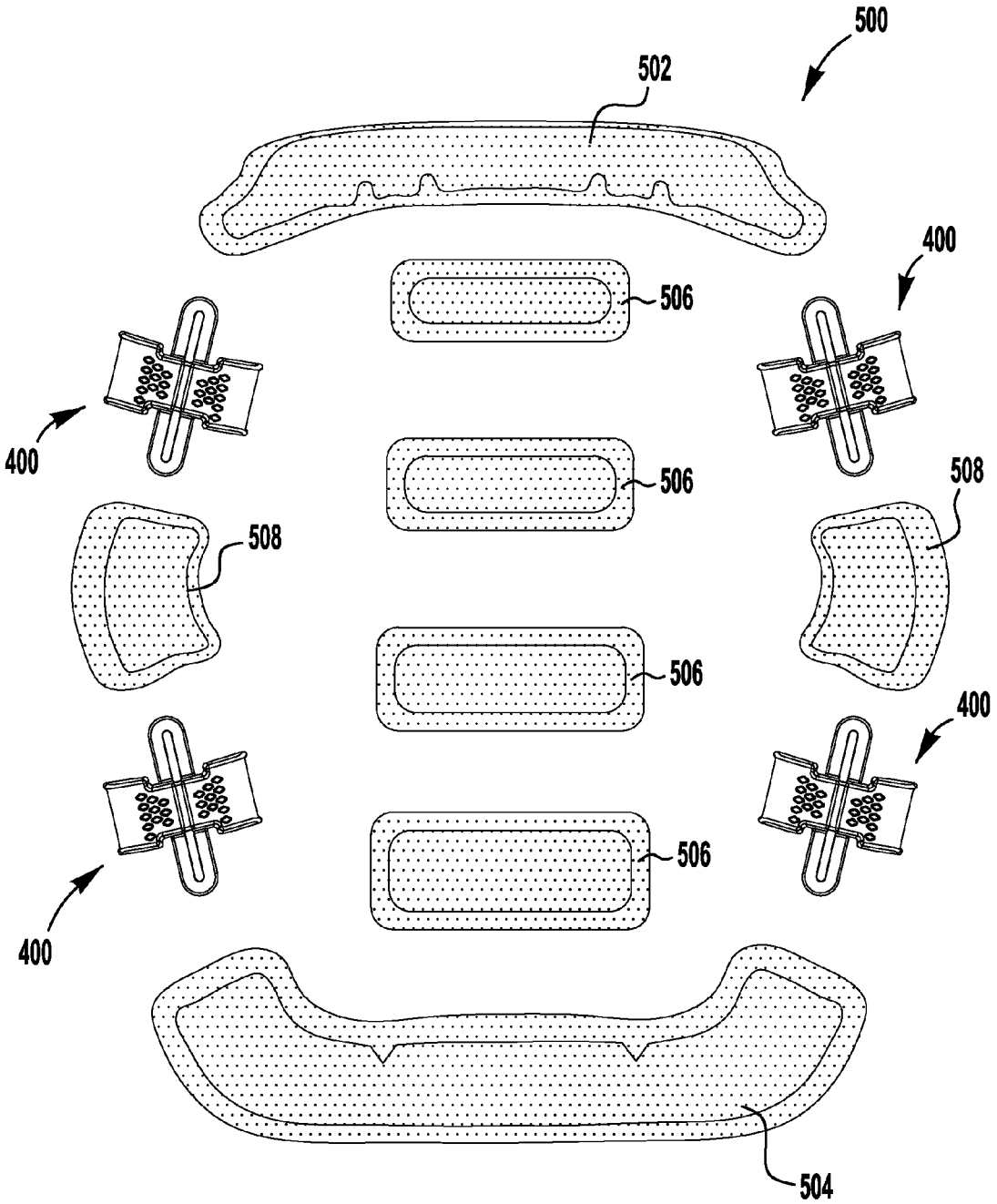
FIG. 5 is a top plan view of comfort pads and air channel inserts according to an embodiment of the present application.

FIG. 5 illustrates an exemplary set of comfort pads 500 and air channel inserts 400 that may be arranged and sold as a kit for a helmet shell. For example, in certain embodiments, an impact liner kit for a helmet shell comprises the impact liner 100, at least one air channel insert (e.g., insert 300, 400, or 450), and a plurality of comfort pads 500. The impact liner 100 is configured to be installed in the interior of the helmet shell to at least partially line the front, rear, and middle portions of the helmet shell. The at least one air channel insert is configured to be installed within one or more of the plurality of air channels formed by the impact liner 100. The plurality of comfort pads 500 are configured to be removably attached to the impact liner 100. As illustrated in FIG. 5, the set of comfort pads 500 comprises a front comfort pad 502, a rear comfort pad 504, left and right comfort pads 508, and a plurality of central comfort pads 506. Further, as illustrated in FIGS. 6 and 7 and described below, the impact liner kit may be used with a variety of different helmet shells, such as, for example, a US Army Advanced Combat Helmet (ACH), a US Marine Corp Lightweight Helmet, an Enhanced Combat Helmet (ECH), a Personal Armor System for Ground Troops (PASGT) helmet, or other typical ballistic helmet shells.

Figure 6:
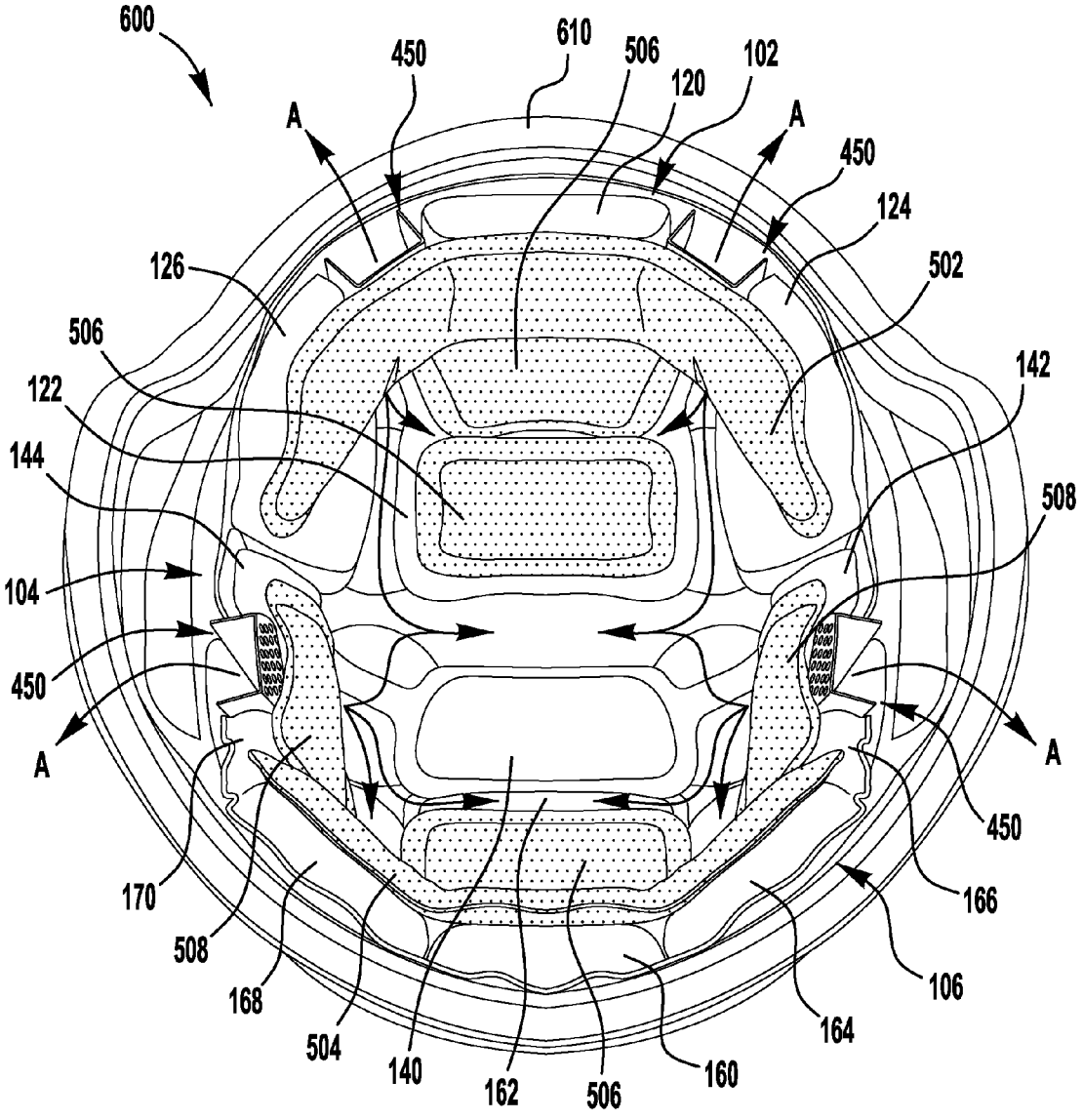
FIG. 6 is a top plan view of an impact liner system installed in a helmet shell according to an embodiment of the present application.
Figure 7:
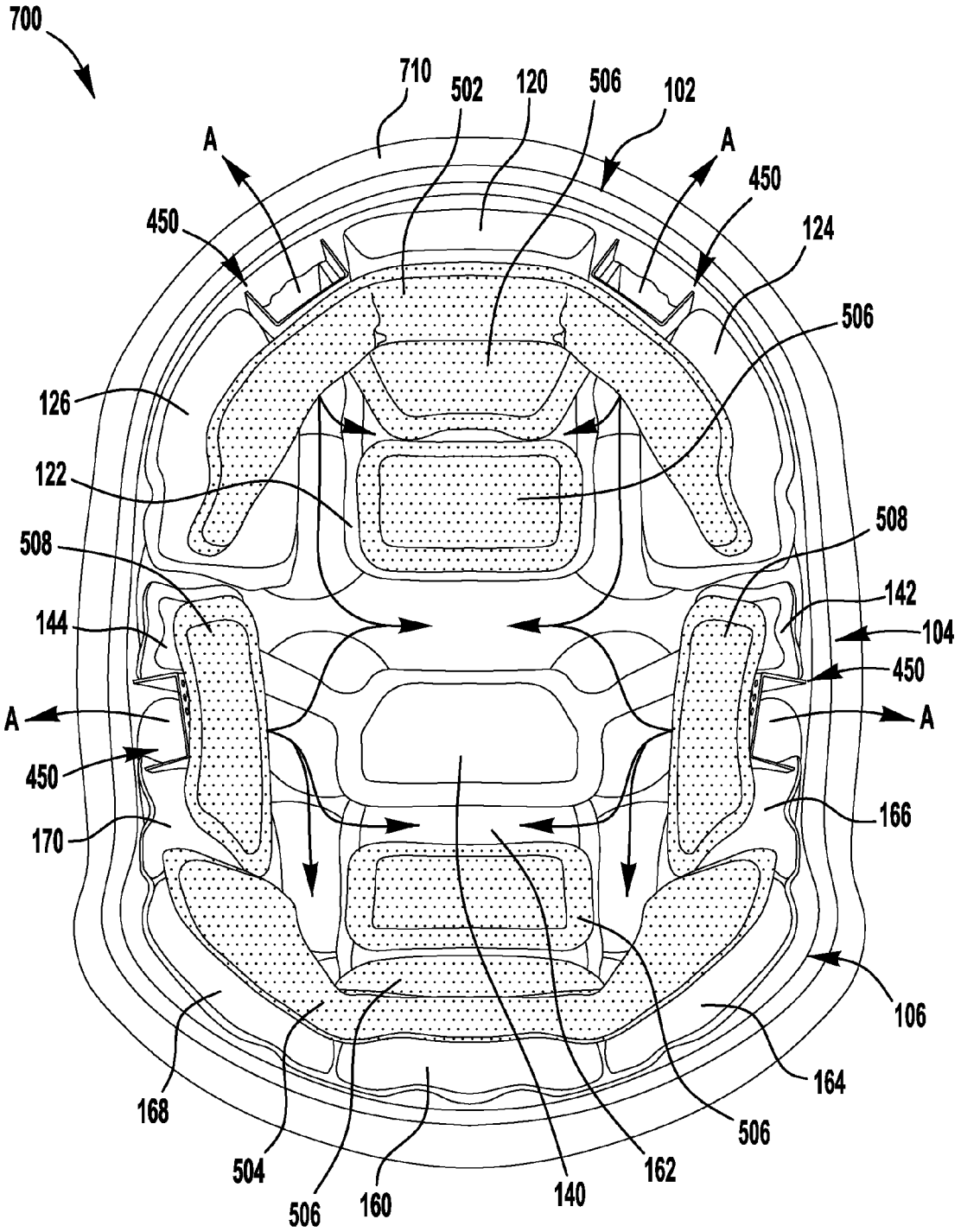
FIG. 7 is a top plan view of an impact liner system installed in a helmet shell according to an embodiment of the present application.

FIGS. 6 and 7 illustrate impact liner systems 600 and 700 according to embodiments of the present application. The impact liner system 600 shown in FIG. 6 comprises the impact liner 100 installed in an Advanced Combat Helmet (ACH) shell 610, one or more comfort pads 500 removably attached to the impact liner, and air channel inserts 450 disposed within air channels of the impact liner. The impact liner system 700 shown in FIG. 7 comprises the impact liner 100 installed in an Advanced Combat Helmet high cut shell 710, one or more comfort pads 500 removably attached to the impact liner, and air channel inserts 450 disposed within air channels of the impact liner.

As illustrated in FIGS. 6 and 7, the impact liner systems 600 and 700 comprise a front comfort pad 502, a rear comfort pad 504, left and right side comfort pads 508, and central comfort pads 506. The comfort pads of the impact liner systems 600 and 700 may be various sizes to adjust the sizing and fit of the helmet shell 610 and 710 on the user's head. Further, the comfort pads may be a variety of other shapes and sizes and may be positioned and/or configured in a variety of ways to comfort various portions of the user's head.

As illustrated in FIGS. 6 and 7, the front comfort pad 502 is removably attached to the impact pads of the front impact pad array 102 and extends across the front and front side portions of the helmet shell 610. The front comfort pad 502 is positioned to provide comfort across the user's forehead and temples. The rear comfort pad 504 is removably attached to the impact pads of the rear impact pad array 106 and extends across the rear and rear side portions of the helmet shell 610. The rear comfort pad 504 is positioned to provide comfort across the rear and rear sides of the user's head (e.g., behind the user's ears). The right and left side comfort pads 508 are removably attached to the impact pads of the middle and rear impact pad arrays 104 and 106 and extend along the side portions of the helmet shell 610. The side comfort pads 508 are positioned to provide comfort along the right and left sides of the user's head (e.g., above the user's ears). The central comfort pads 506 are removably attached to the impact pads of the front and rear impact pad arrays 102 and 106 and along the central portion of the helmet shell 610. The central comfort pads 506 are positioned to provide comfort to the top of the user's head. In other embodiments, one or more central comfort pads 506 may also be attached to the impact pads of the middle impact pad array 104.

When the impact liner 100 is installed in the helmet shell 610 and 710, the impact liner forms a ventilation system configured to cool the user's head. For example, as illustrated in FIGS. 6 and 7, the impact liner 100 comprises a plurality of front, middle, rear, and transverse air channels which collectively form a network of air channels. As shown, front air channels are formed between the impact pads 120, 122, 124, and 126 of the front impact pad array 102, middle air channels are formed between the impact pads 140, 142, 144 of the middle impact pad array 104, and rear air channels are formed between the impact pads 162, 166, and 170 of the rear impact pad array 106. Further, transverse air channels are formed between the impact pads 140, 142, 144 of the middle impact pad array 104, the impact pads 122, 124, and 126 of the front impact pad array 102, and the impact pads 162, 166, and 170 of the rear impact pad array 106. Still further, gaps between the various impact pads of the impact pad arrays 102, 104, 106 form air channels that fluidly communicate with the front, middle, rear, and transverse air channels and form a portion of the network of air channels.

As illustrated in FIGS. 6 and 7, the ventilation system is configured such that air A is permitted to flow in and out of the front and transverse air channel openings and throughout the network of air channels. When the user's head is placed against the impact pads of the impact liner 100 and/or the comfort pads, the air A in the network of air channels flows over the user's head to cool the user's head. Further, air A that is within the helmet shell 610 (e.g., heated air) is permitted to escape out the front and transverse air channel openings through the network of air channels.

As illustrated in FIGS. 6 and 7, the air channel inserts 450 are disposed in two front air channels, a right side transverse air channel, and a left side transverse air channel of the impact liner 100. The air channel inserts 450 are also positioned adjacent the openings of the air channels. Further, the front comfort pad 502 and side comfort pads 508 at least partially cover the top of the air channel inserts 450. As such, the top of the air channel inserts 450 prohibit the front and side comfort pads 502 and 508 from being pressed into the air channels and at least partially blocking the flow of air A through the network of air channels. For example, the forehead of the user may press against the front comfort pad 502, or the side of the user's head may press against the side comfort pads 508, and push a portion of the pad into the air channel. It is contemplated that the air channel inserts 450 may be positioned and configured in a variety of ways to prohibit at least a portion of any one or more of the comfort pads 500 from blocking an air channel.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, component geometries, shapes, and dimensions can be modified without changing the overall role or function of the components. Therefore, the inventive concept, in its broader aspects, is not limited to the specific details, the representative device, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. An impact liner system for a helmet shell, comprising:

an impact liner configured to be installed in the interior of a helmet shell to at least partially line the front, rear, and middle portions of the helmet shell, the impact liner comprising a front impact pad array, a middle impact pad array, and a rear impact pad array, wherein each impact pad array comprises a plurality of impact pads; and wherein the impact liner forms a plurality of air channels between the impact pads of the impact pad arrays when the impact liner is installed in the helmet shell;

wherein at least one air channel is disposed between a user's head, edges of the impact pads of the front impact pad array, and the helmet shell when the helmet shell is installed on the user's head, the at least one air channel comprises an opening located between the helmet shell and the user's head and proximate the front of the helmet shell; and at least one insert disposed within the at least one air channel and comprising at least one vertical wall positioned adjacent an edge of an impact pad of the front impact pad array and configured to prohibit at least a portion of the impact pad from collapsing into the at least one air channel when the helmet shell is installed on a user's head, wherein the at least one vertical wall forms at least a portion of a longitudinal passageway that provides air flow through the insert disposed within the at least one air channel.

2. The impact liner system of claim 1, wherein the impact pad arrays are capable of being folded to substantially conform to the shape of the interior of the helmet shell.

3. The impact liner system of claim 1, wherein each impact pad array is substantially disposed about a centerline of the impact liner such that each impact pad array possesses a geometry on one side of the centerline that is a mirror image of the geometry on the other side of the centerline.

4. The impact liner system of claim 1, wherein the impact pads of each impact pad array are encased in a liner material, and wherein the liner material is configured to hold the impact pads in relative position to one another and attach the impact pads together.

5. The impact liner system of claim 4, wherein the liner material of at least one impact pad array forms a portion of an air channel when the impact liner is installed in the helmet shell.

6. The impact liner system of claim 1, wherein the plurality of air channels comprises a front air channel formed between two or more impact pads of the front impact pad array, a middle air channel formed between two or more impact pads of the middle impact pad array, and a rear air channel formed between two or more impact pads of the rear impact pad array.

7. The impact liner system of claim 6, wherein the front, middle, and rear air channels are in fluid communication.

8. The impact liner system of claim 7, wherein the front, middle, and rear air channels are substantially parallel to a centerline of the impact liner.

9. The impact liner system of claim 7, wherein the front air channel comprises an opening that permits airflow into and out of the front, middle, and rear air channels.

10. The impact liner system of claim 6, wherein the plurality of air channels further comprises a transverse air channel formed between an impact pad of the middle impact pad array and at least one of an impact pad of the front impact pad array and an impact pad of the rear impact pad array.

11. The impact liner system of claim 10, wherein the transverse air channel is in fluid communication with the front, middle, and rear air channels, and wherein the transverse air channel comprises an opening configured to permit airflow into and out of the front, middle, rear, and transverse air channels.

12. The impact liner system of claim 10, wherein the transverse air channel is substantially perpendicular to a centerline of the impact liner.

13. The impact liner system of claim 10, wherein the front, middle, rear, and transverse air channels are in fluid communication, and wherein the front air channel comprises a first opening and the transverse air channel comprises a second opening, and wherein the first and second openings are configured to permit airflow into an out of the plurality of air channels.

14. The impact liner system of claim 13, wherein the plurality of air channels further comprises one or more gaps disposed between the impact pads of one or more impact pad arrays, and wherein the one or more gaps are in fluid communication with the front, middle, rear, and transverse air channels.

15. The impact liner system of claim 13, wherein the at least one insert comprises a body portion having a top and at least two vertical side walls, and wherein the top comprises one or more openings configured to permit airflow therethrough, and the side walls are configured to prohibit at least a portion of the air channel from collapsing when the helmet shell is installed on a user's head.

16. The impact liner system of claim 13, wherein a first insert is disposed within the front air channel adjacent the first opening.

17. The impact liner system of claim 16, wherein a second insert is disposed within the transverse air channel adjacent the second opening.

18. The impact liner system of claim 1, wherein the at least one insert comprises a body portion having a top and vertical side walls, wherein the top comprises one or more openings configured to permit airflow therethrough.

19. The impact liner system of claim 1, further comprising one or more comfort pads removably attached to the impact liner.

20. The impact liner system of claim 1, wherein the at least one insert is rigid.

21. The impact liner system of claim 1, wherein an end of the insert is disposed at the front of the helmet shell.

22. The impact liner system of claim 1, further comprising a fastener for attaching the impact liner to the interior of a ballistic helmet shell without penetrating the ballistic helmet shell.

23. An impact liner system for a helmet shell, comprising:

an impact liner configured to be installed in the interior of a helmet shell to at least partially line the front, rear, and middle portions of the helmet shell, the impact liner comprising a plurality of impact pads, wherein the impact liner forms a plurality of air channels between the impact pads when the impact liner is installed in the helmet shell; and at least one insert configured to be installed within one or more of the plurality of air channels, the insert comprising:

a body portion having vertical side walls and extending from a first end to a second end; and at least one longitudinal passageway formed at least in part by the vertical side walls and extending from the first end to the second end between the vertical side walls to provide air flow through the air channel:

wherein the insert is configured to prohibit at least a portion of the air channel from collapsing when the helmet shell is installed on a user's head.

24. The impact liner system of claim 23, further comprising a plurality of comfort pads configured to be removably attached to the impact liner.

25. The impact liner system of claim 23, wherein the at least one insert is disposed in an air channel of the impact liner located in the front portion of the helmet shell.

26. The impact liner system of claim 23, wherein:

at least one of the air channels is disposed between a user's head and the helmet shell when the helmet shell is installed on the user's head, the at least one air channel having at least one opening proximate the front of the helmet shell; and the insert is disposed within the at least one air channel and one of the first end and the second end of the insert is proximate the front of the helmet shell.

27. The impact liner system of claim 23, further comprising a fastener for attaching the impact liner to the interior of a ballistic helmet shell without penetrating the ballistic helmet shell.

* * * * *